US007219739B2

(12) United States Patent
Robichaux

(10) Patent No.: US 7,219,739 B2
(45) Date of Patent: May 22, 2007

(54) HEAVE COMPENSATION SYSTEM FOR HYDRAULIC WORKOVER

(75) Inventor: Dicky J. Robichaux, Houston, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 11/074,178

(22) Filed: Mar. 7, 2005

(65) Prior Publication Data

US 2006/0196671 A1 Sep. 7, 2006

(51) Int. Cl.
*E21B 29/12* (2006.01)

(52) U.S. Cl. ..... 166/355; 166/352; 166/360

(58) Field of Classification Search ..... 166/352–355, 166/350, 363

See application file for complete search history.

(56) References Cited

U.S. PATENT DOCUMENTS

| | | | | |
|---|---|---|---|---|
| 3,280,908 | A | 10/1966 | Todd | 166/340 |
| 3,313,345 | A | 4/1967 | Fischer | 166/355 |
| 3,643,751 | A | 2/1972 | Crickmer | 175/7 |
| 3,955,621 | A | 5/1976 | Webb | 166/0.5 |
| 4,068,868 | A | 1/1978 | Ohrt | 285/263 |
| 4,215,950 | A | 8/1980 | Stevenson | 405/195 |
| 4,317,586 | A | 3/1982 | Campbell | 285/95 |
| 4,367,981 | A | 1/1983 | Shapiro | 405/195 |
| 4,379,657 | A | 4/1983 | Widiner et al. | 405/195 |
| 4,615,542 | A | 10/1986 | Ideno et al. | 285/11 |
| 4,712,620 | A | 12/1987 | Lim et al. | 166/355 |
| 4,787,778 | A | 11/1988 | Myers et al. | 405/195 |
| 4,808,035 | A | 2/1989 | Stanton et al. | 405/195 |
| 4,883,387 | A | 11/1989 | Myers et al. | 405/195 |
| 5,727,630 | A | 3/1998 | Brammer | 166/355 |
| 5,846,028 | A | 12/1998 | Thory | 405/195.1 |
| 5,951,061 | A | 9/1999 | Arlt, III et al. | 285/94 |
| 6,419,277 | B1 | 7/2002 | Reynolds | 285/123.1 |
| 6,530,430 | B2 | 3/2003 | Reynolds | 166/346 |
| 6,554,072 | B1 | 4/2003 | Mournian et al. | 166/355 |
| 6,585,455 | B1 * | 7/2003 | Petersen et al. | 405/224.4 |
| 6,691,784 | B1 * | 2/2004 | Wanvik | 166/355 |

(Continued)

FOREIGN PATENT DOCUMENTS

| | | | |
|---|---|---|---|
| GB | 2141470 | A | 12/1984 |

(Continued)

*Primary Examiner*—Thomas A Beach
(74) *Attorney, Agent, or Firm*—John W. Wustenberg; Baker Botts, L.L.P.

(57) ABSTRACT

The present invention relates generally to offshore drilling and production operations, and, more particularly, to marine drilling workover/intervention tensioning and compensating devices and methodologies. A heave compensated hydraulic workover device and/or system is provided comprising a hydraulic tensioning cylinder system disposed beneath a rig floor and adapted to be connected at a mandrel to the rig floor through a rotary table disposed in the rig floor. The heave compensated hydraulic workover device and/or system also comprises a well intervention apparatus disposed at least partially within the hydraulic tensioning cylinder system beneath the rig floor, the well intervention apparatus capable of being used in conjunction with at least one of a well, a wellhead, a blow-out pressure system, a jointed tubular, a pipe, and a drilling string. In various aspects, the well intervention apparatus comprises at least one of a hydraulic workover device, a hydraulic jacking system, a coiled tubing apparatus, a wireline device, a slickline device, and an electric line.

22 Claims, 30 Drawing Sheets

U.S. PATENT DOCUMENTS

Figure 1:
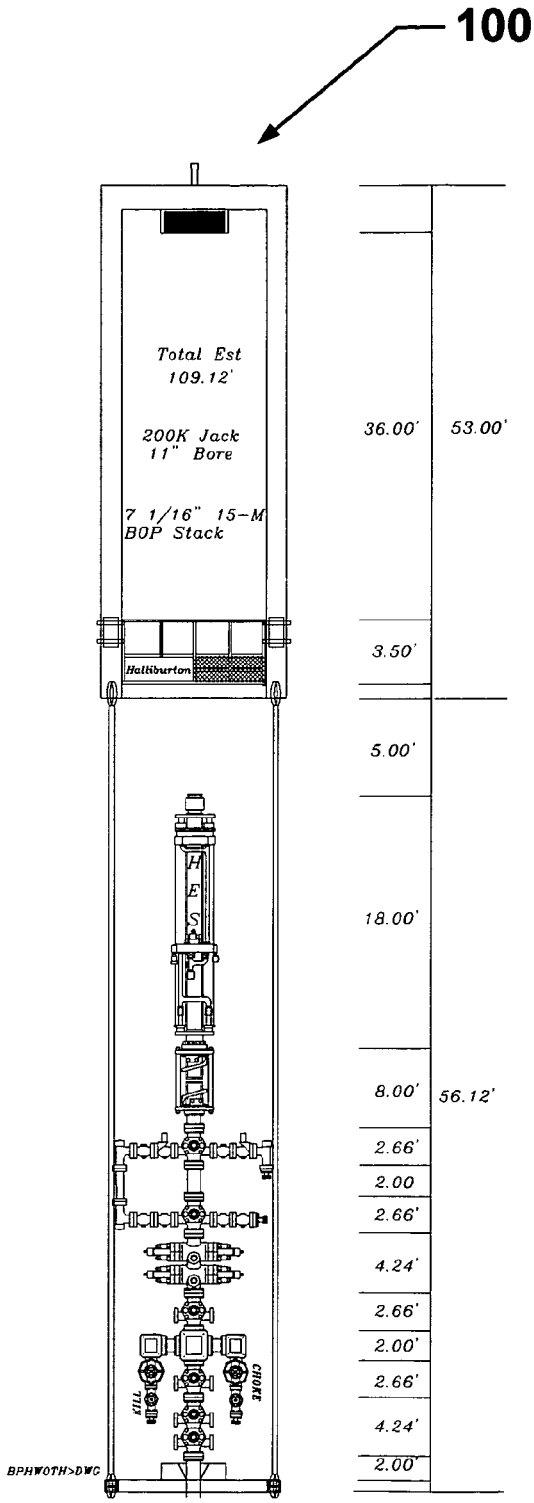
Figure 1 (Prior Art)

| | | | | |
|---|---|---|---|---|
| 6,814,140 | B2 * | 11/2004 | Robichaux | 166/77.4 |
| 6,868,902 | B1 * | 3/2005 | Roodenburg et al. | 166/77.2 |
| 7,080,689 | B2 * | 7/2006 | Guesnon et al. | 166/355 |
| 2002/0000321 | A1 | 1/2002 | Reynolds | 166/355 |
| 2006/0180314 | A1 * | 8/2006 | Williams | 166/355 |

FOREIGN PATENT DOCUMENTS

| | | |
|---|---|---|
| WO | WO 97/43516 | 11/1997 |
| WO | WO 00/24998 | 5/2000 |

* cited by examiner

HEAVE COMPENSATION SYSTEM FOR HYDRAULIC WORKOVER

BACKGROUND

The present invention relates generally to offshore drilling and production operations, and, more particularly, to marine drilling workover/intervention tensioning and compensating devices and methodologies.

A marine riser system may be employed to provide a conduit from a floating vessel at the water surface to the blowout preventer stack or production tree, which may be connected to the wellhead at the sea floor. A tensioning system may be utilized to maintain a variable tension in the riser string alleviating the potential for compression and, in turn, buckling or failure.

Historically, conventional riser tensioner systems have consisted of both single and dual cylinder assemblies with a fixed cable sheave at one end of the cylinder and a movable cable sheave attached to the rod end of the cylinder. The assembly is then mounted in a position on the vessel to allow convenient routing of wire rope that is connected to a point at the fixed end and strung over the movable sheaves. A hydro/pneumatic system consisting of high pressure air over hydraulic fluid applied to the cylinder forces the rod and in turn the rod end sheave to stroke out thereby tensioning the wire rope and in turn the riser.

The number of tensioner units employed is based on the tension necessary to maintain support of the riser and a percentage of overpull that is dictated by met-ocean conditions, i.e., current and operational parameters including variable mud weight, and the like.

Normal operation of these conventional type tensioning systems have required high maintenance due to the constant motion producing wear and degradation of the wire rope members. Replacing the active working sections of the wire rope by slipping and cutting raises safety concerns for personnel and has not proven cost effective. In addition, available space for installation and the structure necessary to support the units, including weight and loads imposed, particularly in deep water applications where the tension necessary requires additional tensioners, poses difficult problems for system configurations for both new vessel designs and upgrading existing vessel designs.

Recent deepwater development commitments have created a need for new generation drilling vessels and production facilities requiring a plethora of new technologies and systems to operate effectively in deep water and alien/harsh environments. These new technologies include riser tensioner development where direct acting cylinders are utilized.

Current systems as manufactured by Hydralift employ individual cylinders arranged to connect one end to the underside of the vessel sub-structure and one end to the riser string. These direct acting cylinders are equipped with ball joint assemblies in both the rod end and cylinder end to compensate for riser angle and vessel offset. Although this arrangement is an improvement over conventional wire rope systems, there are both operational and configurational problems associated with the application and vessel interface. For example, one problem is the occurrence of rod and seal failure due to the bending induced by unequal and non-linear loading caused by vessel roll and pitch. Additionally, these systems cannot slide off of the well bore centerline to allow access to the well. For example, the crew on the oil drilling vessel is not able to access equipment on the seabed floor without having to remove and breakdown the riser string.

The tensioner system as described in U.S. Pat. Nos. 6,530,430 and 6,554,072, both of which are incorporated herein by reference in their entirety, was an improvement over then-existing conventional and direct acting tensioning systems. Beyond the normal operational application to provide a means to apply variable tension to the riser, such a system provides a number of enhancements and options including vessel configuration and its operational criteria.

Such a tensioner system has a direct and positive impact on vessel application and operating parameters by extending the depth of the water in which such a system may be used and operational capability. In particular, such a system is adaptable to existing medium class vessels considered for upgrade by reducing the structure, space, top-side weight and complexity in wire rope routing and maintenance, while at the same time increasing the number of operations which can be performed by a given vessel equipped with such a tensioner system.

Additionally, such a tensioner system extends operational capabilities to deeper waters than other conventional tensioners by permitting increased tension while reducing the size and height of the vessel structure, reducing the amount of deck space required for the tensioner system, reducing the top-side weight, and increasing the oil drilling vessel's stability by lowering its center of gravity.

Moreover, such a tensioner system is co-linearly symmetrical with tensioning cylinders. Therefore, such a tensioner system eliminates offset and the resulting unequal loading that causes rapid rod and seal failure in some previous systems.

Such a tensioner is also radially arranged and may be affixed to the vessel at a single point. Therefore, such a tensioner may be conveniently installed or removed as a single unit through a rotary table opening, or disconnected and moved horizontally while still under the vessel.

Such a tensioner system further offers operational advantages over conventional methodologies by providing options in riser management and current well construction techniques. Applications of the basic module design are not limited to drilling risers and floating drilling vessels. Such a system further provides cost and operational effective solutions in well servicing/workover, intervention and production riser applications. These applications include all floating production facilities including, tension leg platform (T.L.P.) floating production facility (F.P.F.) and production spar variants. Such a system, when installed, provides an effective solution to tensioning requirements and operating parameters including improving safety by eliminating the need for personnel to slip and cut tensioner wires with the riser suspended in the vessel moon pool. An integral control and data acquisition system provides operating parameters to a central processor system which provides supervisory control.

However, such a tensioner system, as described in U.S. Pat. Nos. 6,530,430 and 6,554,072, has the drawback that the manifold therein requires at least two radial fluid bands, wherein at least one of the at least two radial fluid bands is in communication with each of the tensioning cylinders therein, so that individual control of each tensioning cylinder separately is not possible in such a tensioner system. In addition, the rod ends of the tensioning cylinders are required to communicate with flexjoint bearings, adding to the complexity and expense of such a tensioner system.

Hydraulic workover (HWO) units are conventionally rigged up either in a non-compensated fashion (rigged up and connected to the rig floor by pipe slips), or in a motion compensated system by using the drill rig's own compensation system, as shown, for example, in FIG. 1. For motion compensation, the HWO units can be rigged up in a tension lift frame assembly similar to the way coiled tubing injectors are rigged up. The tension lift frame may be connected to the top drive, as indicated at 100, and is motion compensated through the drill line's own compensation system. However, this leaves the HWO unit occupying valuable real estate above and/or on the rig floor, increases the overall height above the rig floor, which increases the danger potentially posed by objects that may fall from above the rig floor, and ties up the rig block.

SUMMARY

The present invention relates generally to offshore drilling and production operations, and, more particularly, to marine drilling workover/intervention tensioning and compensating devices and methods that overcome or at least minimize some of the drawbacks of prior art marine drilling workover/intervention tensioning and compensating devices and methods.

A heave compensated hydraulic workover device and/or system is provided comprising a hydraulic tensioning cylinder system comprising at least one mandrel, at least one flexjoint swivel assembly in communication with the at least one mandrel, at least one manifold in communication with the at least one flexjoint swivel assembly, the at least one manifold having a first radial fluid band and a second radial fluid band, a plurality of tensioning cylinders each having an upper blind end, a lower rod end, and at least one transfer tubing, the upper blind end being in communication with the first radial fluid band, the at least one transfer tubing being in communication with the second radial fluid band and the lower rod end being in communication with a bearing joint that is a flexjoint bearing, and a base in communication with the bearing joint, the hydraulic tensioning cylinder system disposed beneath a rig floor and adapted to be connected at the at least one mandrel to the rig floor through a rotary table disposed in the rig floor. The heave compensated hydraulic workover device and/or system also comprises a well intervention apparatus disposed at least partially within the hydraulic tensioning cylinder system beneath the rig floor, the well intervention apparatus capable of being used in conjunction with at least one of a well, a wellhead, a blow-out pressure system, a jointed tubular, a pipe, and a drilling string.

The heave compensated hydraulic workover system may also comprise a blow-out pressure system disposed in a frame system beneath the well intervention apparatus. The blow-out pressure system may also optionally be disposed at least partially internal to the hydraulic tensioning cylinder system. In various aspects, the well intervention apparatus comprises at least one of a hydraulic workover device, a hydraulic jacking system, a coiled tubing apparatus, a wireline device, a slickline device, and an electric line.

Methods of using a heave compensated hydraulic workover device and/or system are provided, the methods comprising providing a heave compensated hydraulic workover system comprising a hydraulic tensioning cylinder system comprising at least one mandrel, at least one flexjoint swivel assembly in communication with the at least one mandrel, at least one manifold in communication with the at least one flexjoint swivel assembly, the at least one manifold having a first radial fluid band and a second radial fluid band, a plurality of tensioning cylinders each having an upper blind end, a lower rod end, and at least one transfer tubing, the upper blind end being in communication with the first radial fluid band, the at least one transfer tubing being in communication with the second radial fluid band and the lower rod end being in communication with a bearing joint that is a flexjoint bearing, and a base in communication with the bearing joint, the hydraulic tensioning cylinder system disposed beneath a rig floor and adapted to be connected at the at least one mandrel to the rig floor through a rotary table disposed in the rig floor. The heave compensated hydraulic workover device and/or system also comprises a well intervention apparatus disposed at least partially within the hydraulic tensioning cylinder system beneath the rig floor, the well intervention apparatus capable of being used in conjunction with at least one of a well, a wellhead, a blow-out pressure system, a jointed tubular, a pipe, and a drilling string.

The heave compensated hydraulic workover system may also comprise a blow-out pressure system disposed in a frame system beneath the well intervention apparatus. The blow-out pressure system may also optionally be disposed at least partially internal to the hydraulic tensioning cylinder system. In various aspects, the well intervention apparatus comprises at least one of a hydraulic workover device, a hydraulic jacking system, a coiled tubing apparatus, a wireline device, a slickline device, and an electric line. The methods also comprise using the heave compensated hydraulic workover system to intervene with and operate on the at least one of the well, the wellhead, the blow-out pressure system, the jointed tubular, the pipe, and the drilling string.

In one aspect, a heave compensated hydraulic workover device and/or system is provided comprising a hydraulic tensioning cylinder system comprising at least one mandrel, at least one flexjoint swivel assembly in communication with the at least one mandrel, at least one manifold in communication with the at least one flexjoint swivel assembly, the at least one manifold having a first radial fluid band and a second radial fluid band, a plurality of tensioning cylinders each having an upper blind end, a lower rod end, and at least one transfer tubing, the upper blind end being in communication with the first radial fluid band, the at least one transfer tubing being in communication with the second radial fluid band and the lower rod end being in communication with a bearing joint that is a flexjoint bearing, and a base in communication with the bearing joint, the hydraulic tensioning cylinder system disposed beneath a rig floor and adapted to be connected at the at least one mandrel to the rig floor through a rotary table disposed in the rig floor. The heave compensated hydraulic workover device and/or system also comprises a hydraulic jacking system comprising a plurality of hydraulic cylinders, the hydraulic jacking system having a first portion and a second portion, the hydraulic jacking system disposed within the hydraulic tensioning cylinder system beneath the rig floor and stationary/rotary slips disposed within the hydraulic tensioning cylinder system and connected to one of the first portion and the second portion of the hydraulic jacking system. The heave compensated hydraulic workover device and/or system also comprises traveling slips disposed within the hydraulic tensioning cylinder system and connected to the one of the first portion and the second portion of the hydraulic jacking system not connected to the stationary/rotary slips and a telescoping guide system disposed within the hydraulic tensioning cylinder system and connected to the traveling slips disposed within the hydraulic tensioning cylinder system. The heave compensated hydraulic workover system also comprises a blow-out pressure system disposed in a frame system beneath the well intervention apparatus and at least partially internal to the hydraulic tensioning cylinder system.

In another aspect, a heave compensated hydraulic workover device and/or system is provided comprising stationary/rotary slips having an upper portion and a lower portion, the stationary/rotary slips adapted to be connected to the rig floor through a rotary table disposed in the rig floor and a hydraulic jacking system comprising a plurality of hydraulic cylinders, the hydraulic jacking system having a first portion connected to the stationary/rotary slips and a second portion, the hydraulic jacking system disposed beneath the rig floor. The heave compensated hydraulic workover device and/or system also comprises a hydraulic tensioning cylinder system disposed external to the hydraulic jacking system and connected to the second portion of the hydraulic jacking system, the hydraulic tensioning cylinder system comprising at least one mandrel, at least one flexjoint swivel assembly in communication with the at least one mandrel, at least one manifold in communication with the at least one flexjoint swivel assembly, the at least one manifold having a first radial fluid band and a second radial fluid band, a plurality of tensioning cylinders each having an upper blind end, a lower rod end, and at least one transfer tubing, the upper blind end being in communication with the first radial fluid band, the at least one transfer tubing being in communication with the second radial fluid band and the lower rod end being in communication with a bearing joint that is a flexjoint bearing, and a base in communication with the bearing joint, the hydraulic tensioning cylinder system disposed beneath a rig floor. The heave compensated hydraulic workover device and/or system also comprises a rotary swivel disposed within the hydraulic tensioning cylinder system and connected to the second portion of the hydraulic jacking system, traveling slips disposed within the hydraulic tensioning cylinder system and connected to the rotary swivel, and a telescoping guide system disposed within the hydraulic tensioning cylinder system and connected to the traveling slip. The heave compensated hydraulic workover system also comprises a blow-out pressure system disposed in a frame system beneath the well intervention apparatus and at least partially internal to the hydraulic tensioning cylinder system.

In yet another aspect, methods for running jointed tubulars in a compensated fashion and for moving pipe in a pipe light mode using a heave compensated hydraulic workover device and/or system are provided, the methods comprising providing a heave compensated hydraulic workover system comprising at least one mandrel, at least one flexjoint swivel assembly in communication with the at least one mandrel, at least one manifold in communication with the at least one flexjoint swivel assembly, the at least one manifold having a first radial fluid band and a second radial fluid band, a plurality of tensioning cylinders each having an upper blind end, a lower rod end, and at least one transfer tubing, the upper blind end being in communication with the first radial fluid band, the at least one transfer tubing being in communication with the second radial fluid band and the lower rod end being in communication with a bearing joint that is a flexjoint bearing, and a base in communication with the bearing joint, the hydraulic tensioning cylinder system disposed beneath a rig floor and adapted to be connected at the at least one mandrel to the rig floor through a rotary table disposed in the rig floor. The heave compensated hydraulic workover device and/or system also comprises a hydraulic jacking system comprising a plurality of hydraulic cylinders, the hydraulic jacking system having a first portion and a second portion, the hydraulic jacking system disposed within the hydraulic tensioning cylinder system beneath the rig floor and stationary/rotary slips disposed within the hydraulic tensioning cylinder system and connected to one of the first portion and the second portion of the hydraulic jacking system.

The heave compensated hydraulic workover device and/or system also comprises traveling slips disposed within the hydraulic tensioning cylinder system and connected to the one of the first portion and the second portion of the hydraulic jacking system not connected to the stationary/rotary slips and a telescoping guide system disposed within the hydraulic tensioning cylinder system and connected to the traveling slips disposed within the hydraulic tensioning cylinder system. The heave compensated hydraulic workover system also comprises a blow-out pressure system disposed in a frame system beneath the well intervention apparatus and at least partially internal to the hydraulic tensioning cylinder system. The methods also comprise using the heave compensated hydraulic workover device to do at least one of running jointed tubulars in a compensated fashion and moving pipe in a pipe light mode.

The features and advantages of the present invention will be readily apparent to those skilled in the art upon a reading of the description of the embodiments that follows.

DRAWINGS

The following figures form part of the present specification and are included to further demonstrate certain aspects of the present invention. The present invention may be better understood by reference to one or more of these drawings in combination with the description of embodiments presented herein.

Figure 2:
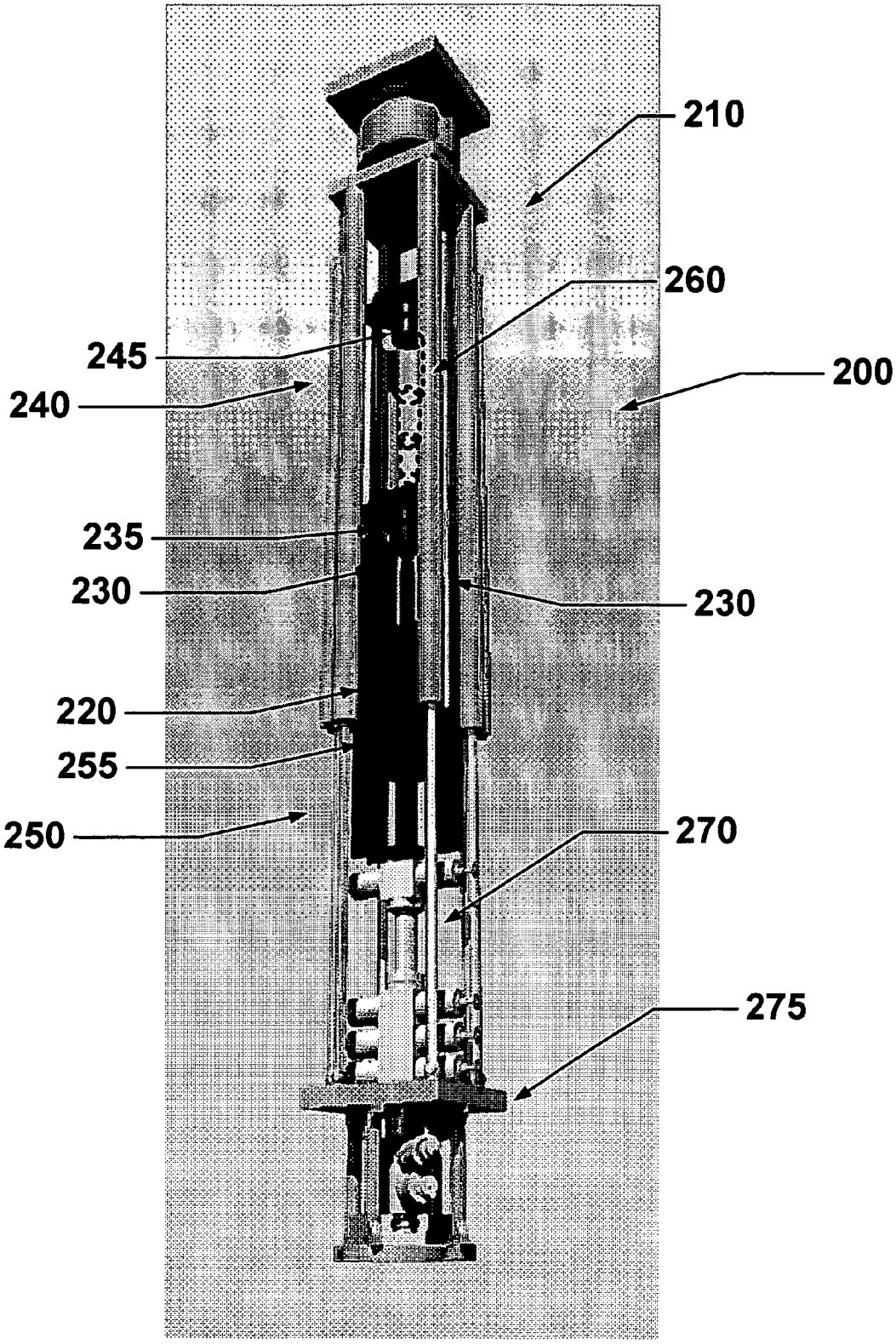
Figure 3:
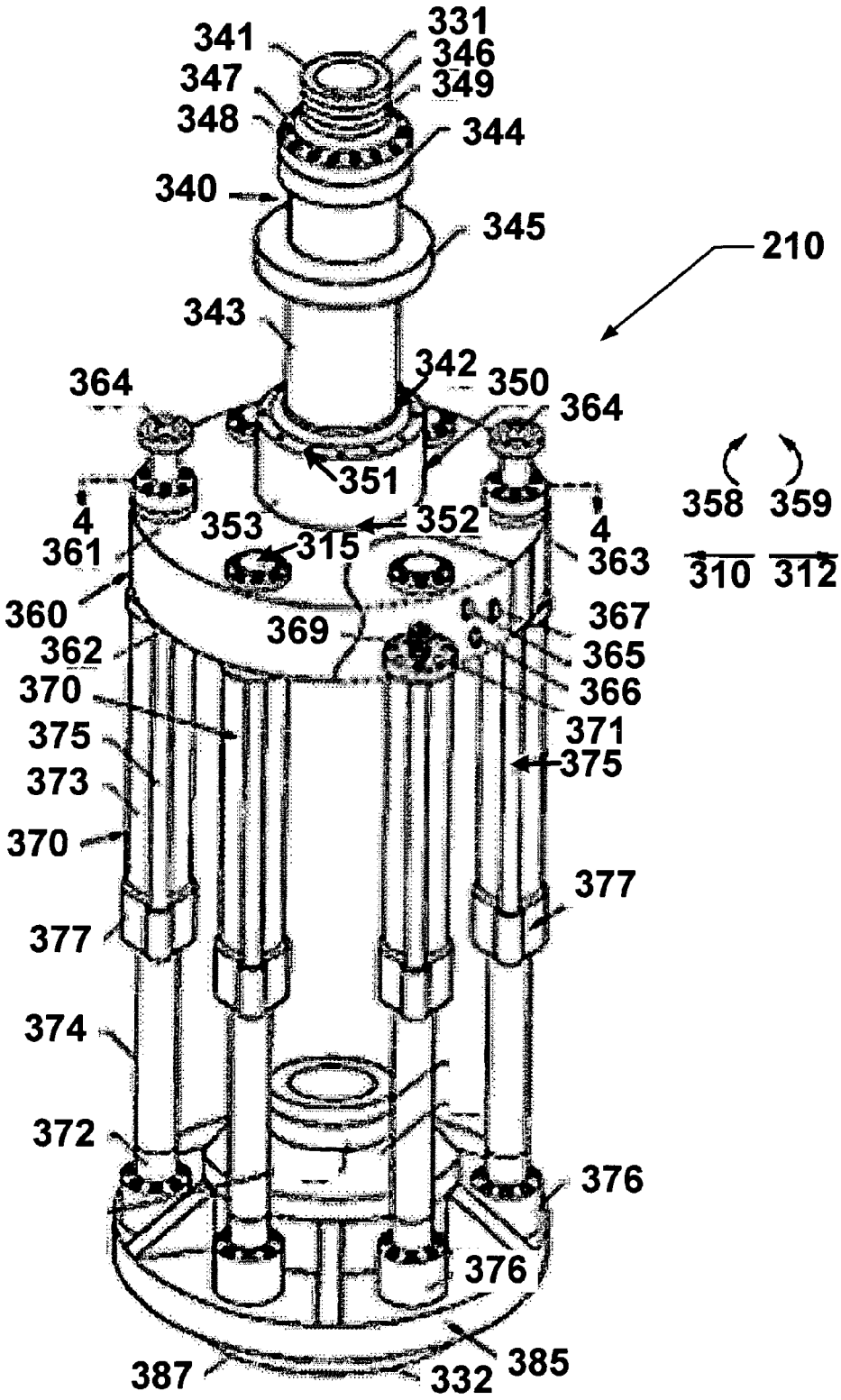
Figure 4:
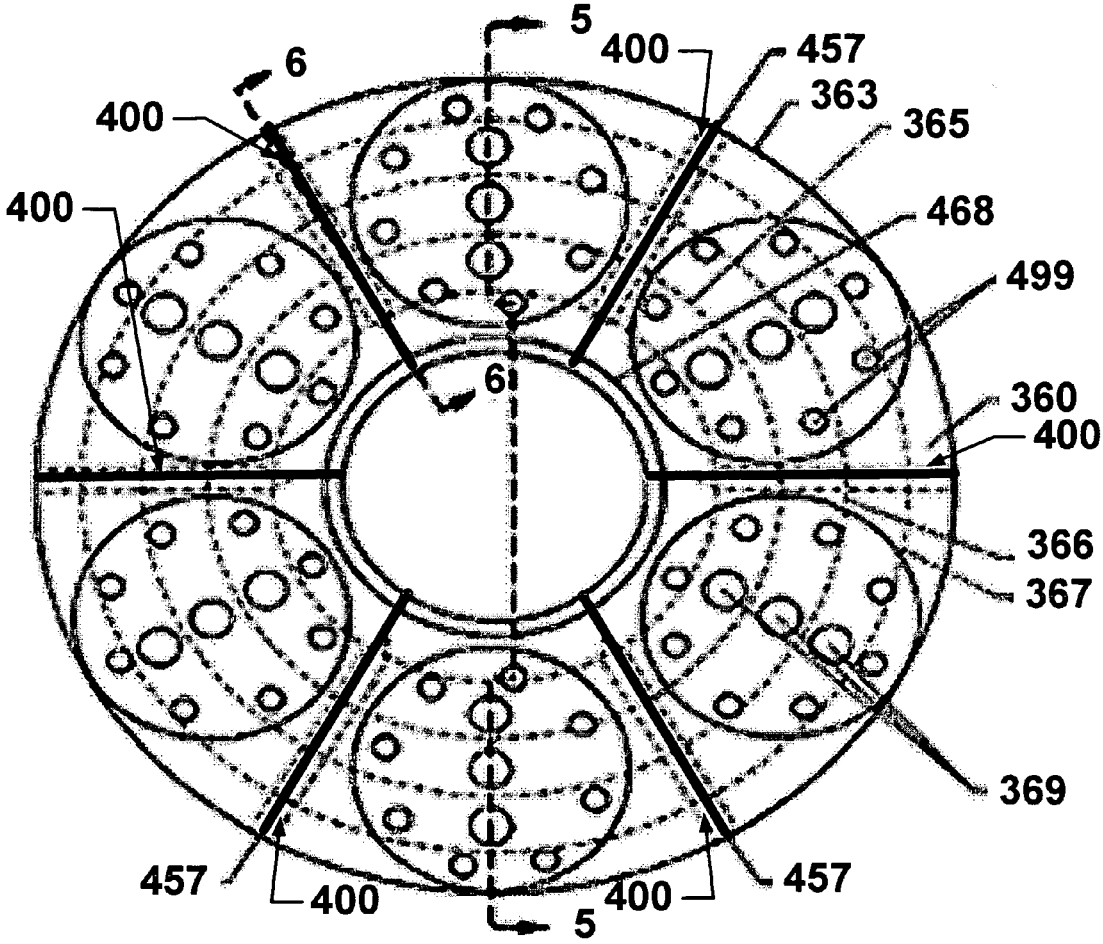
Figure 5:
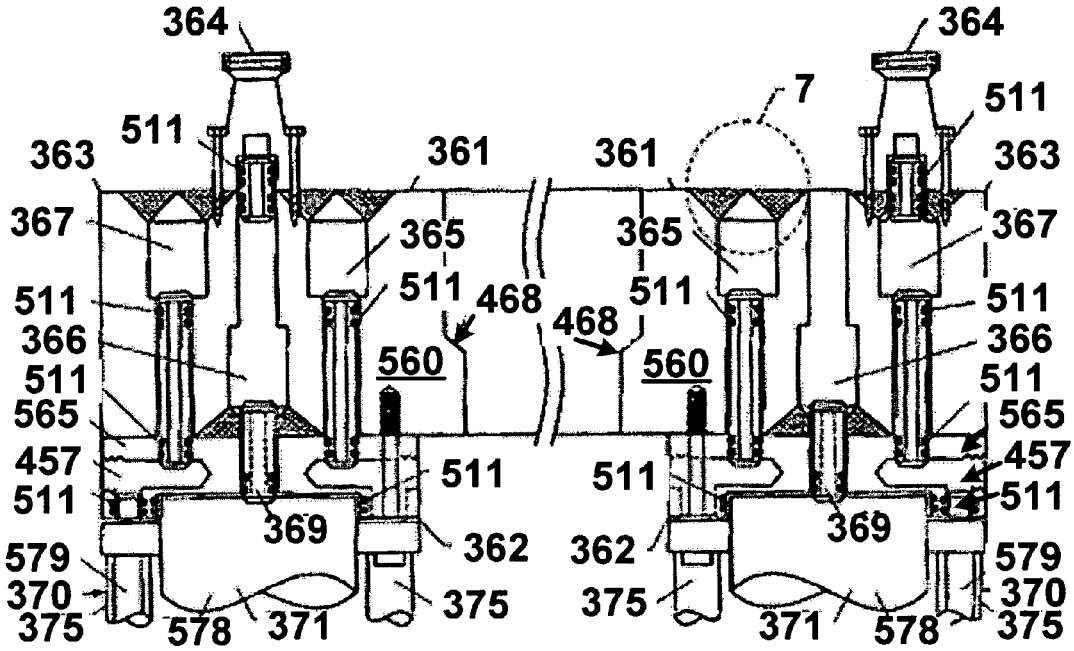
Figure 6:
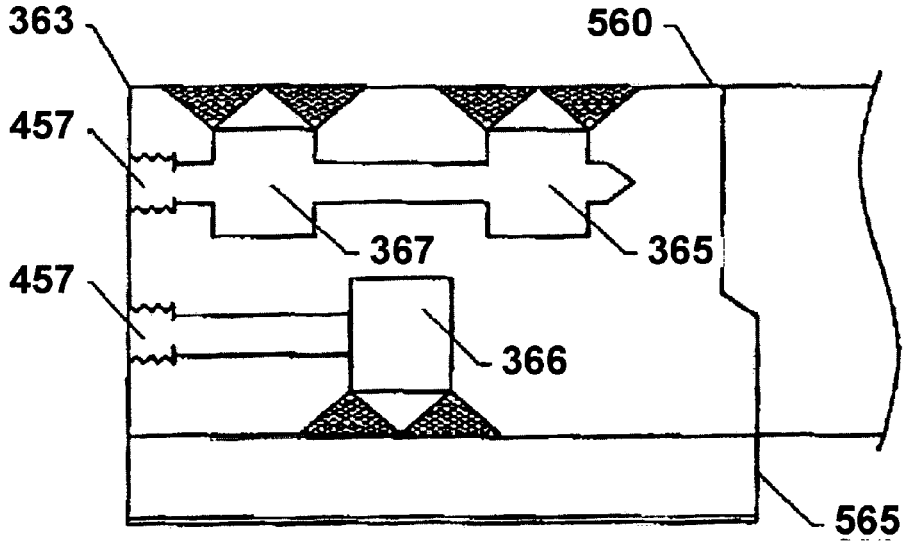
Figure 7:
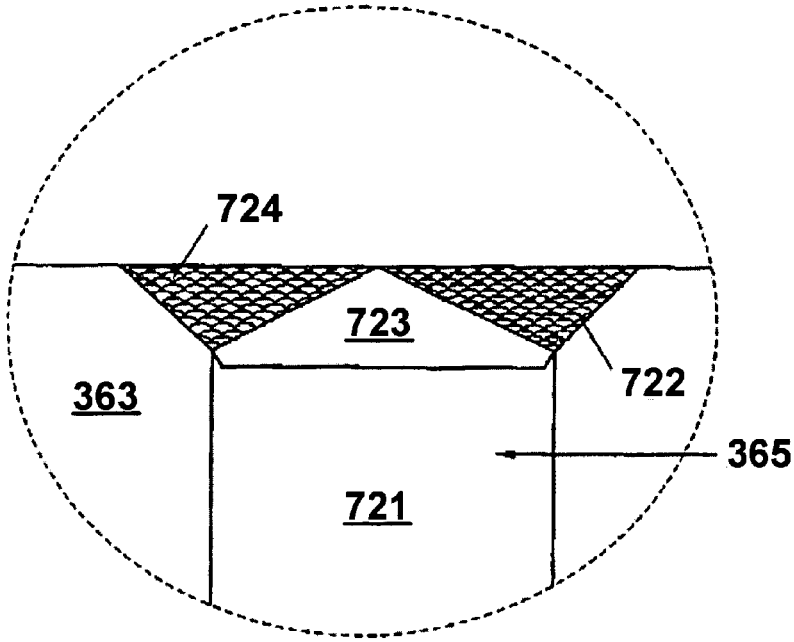
Figure 8:
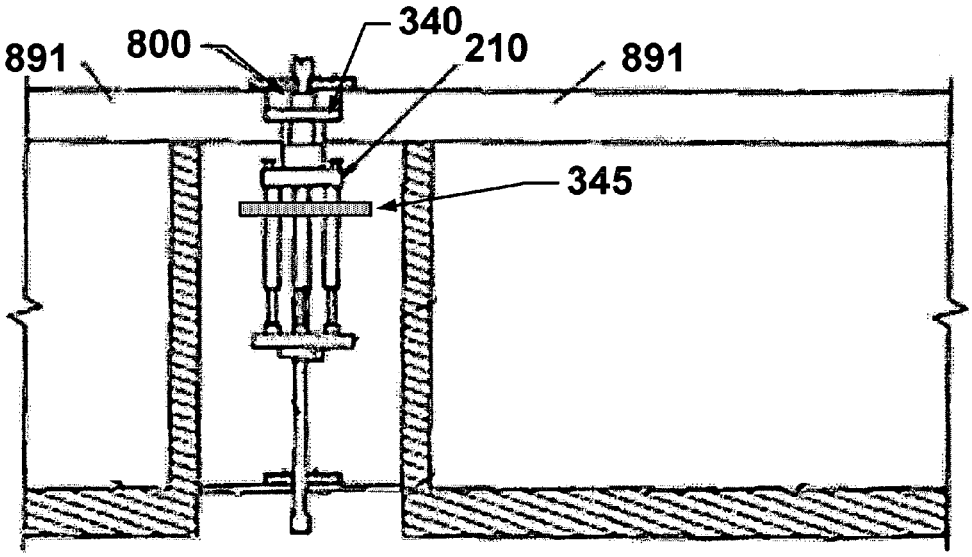
Figure 9:
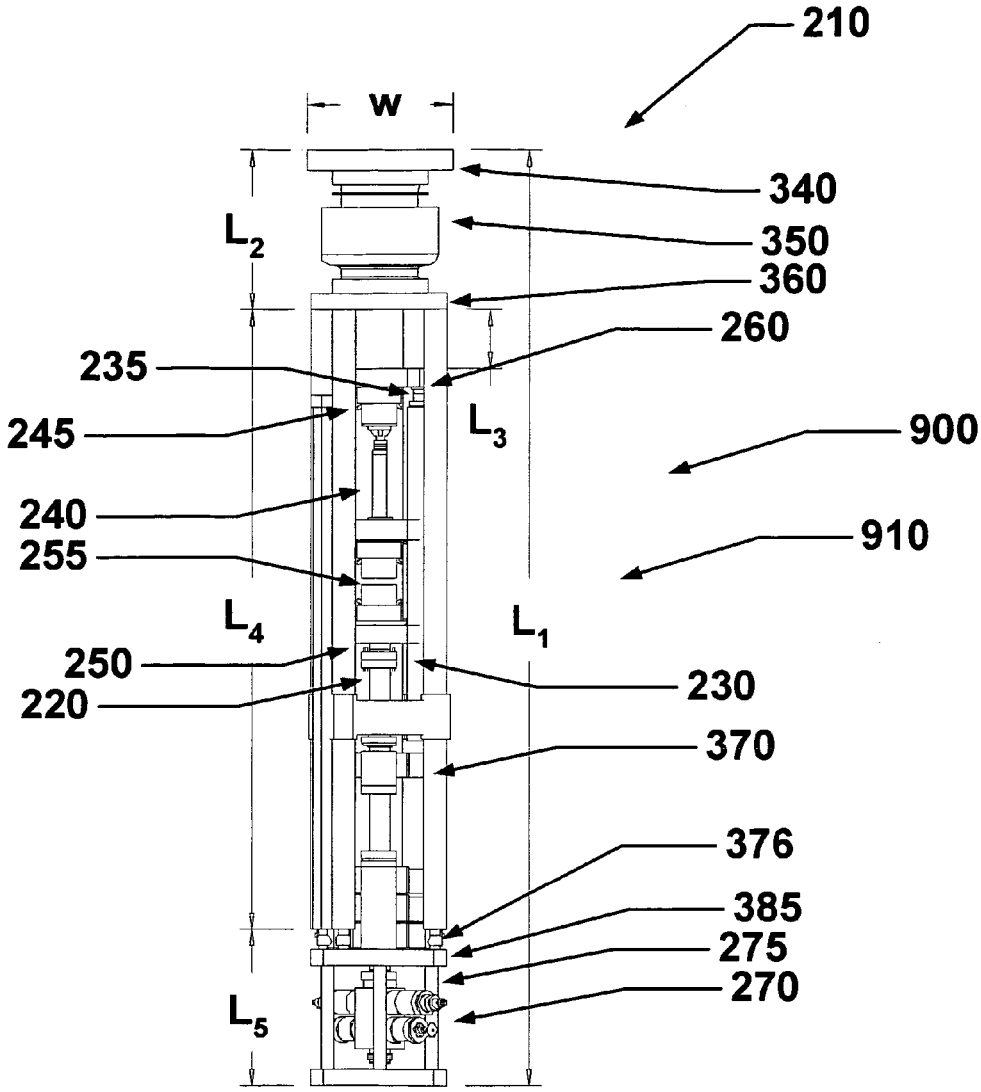
Figure 10:
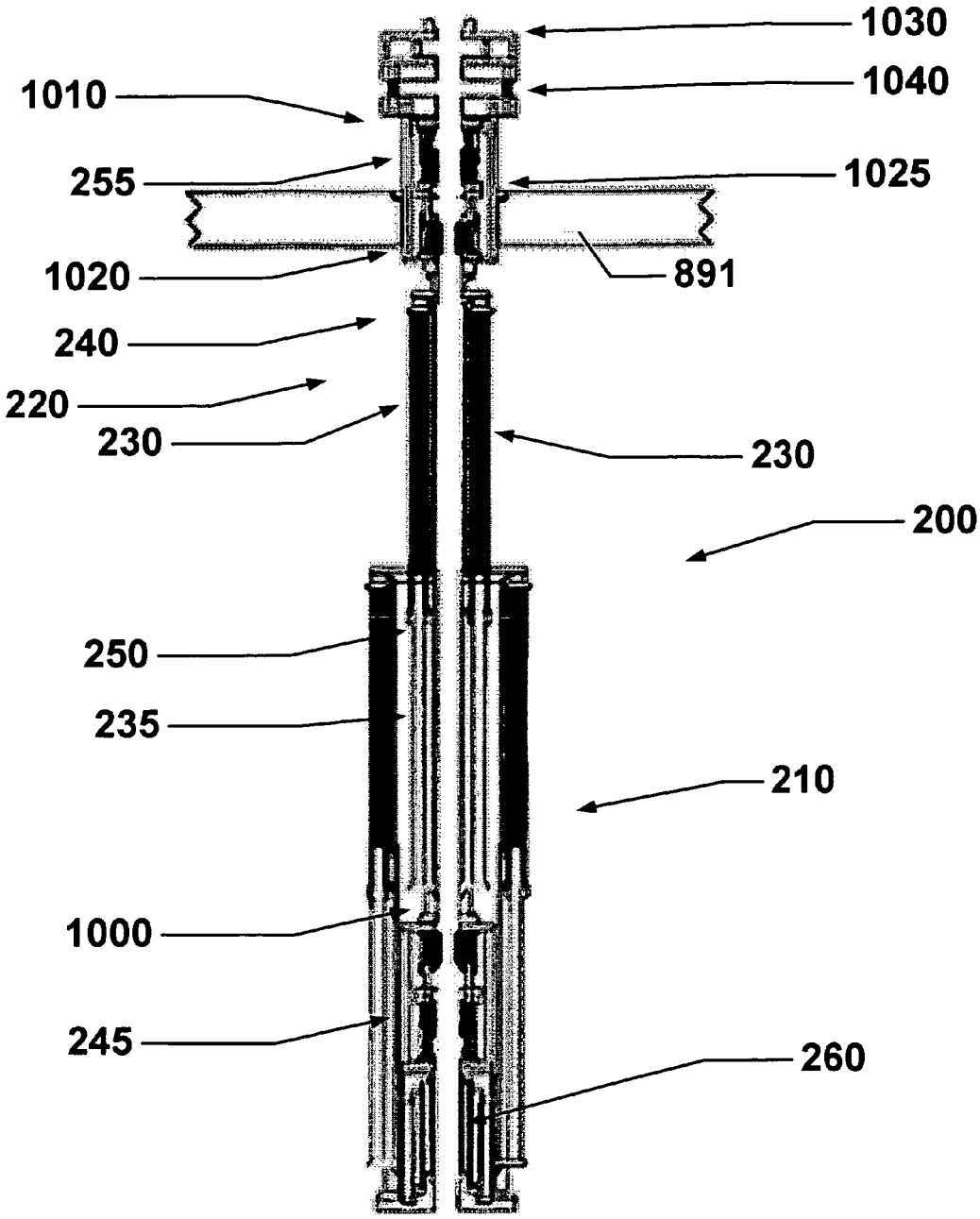
Figure 11:
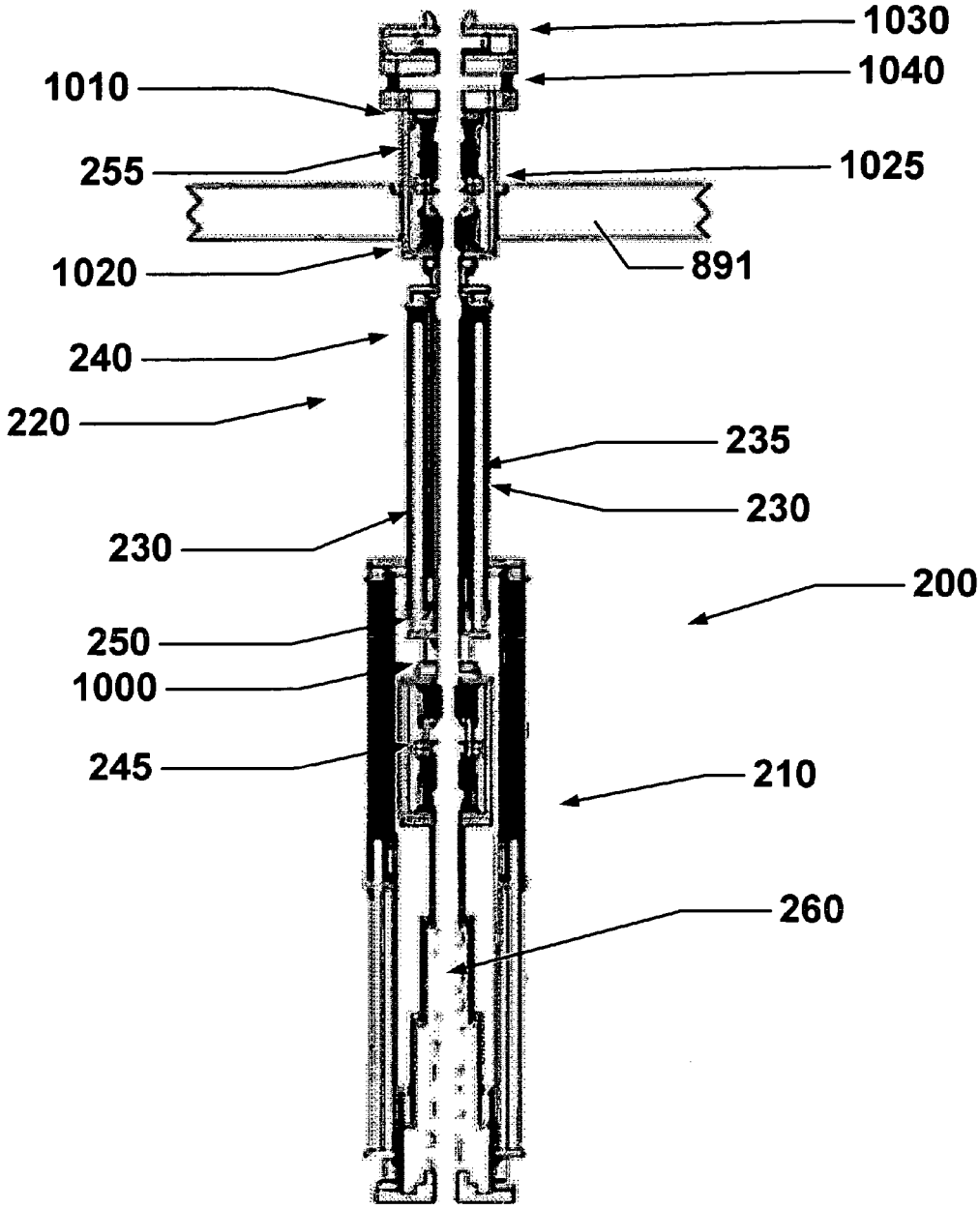
Figure 12:
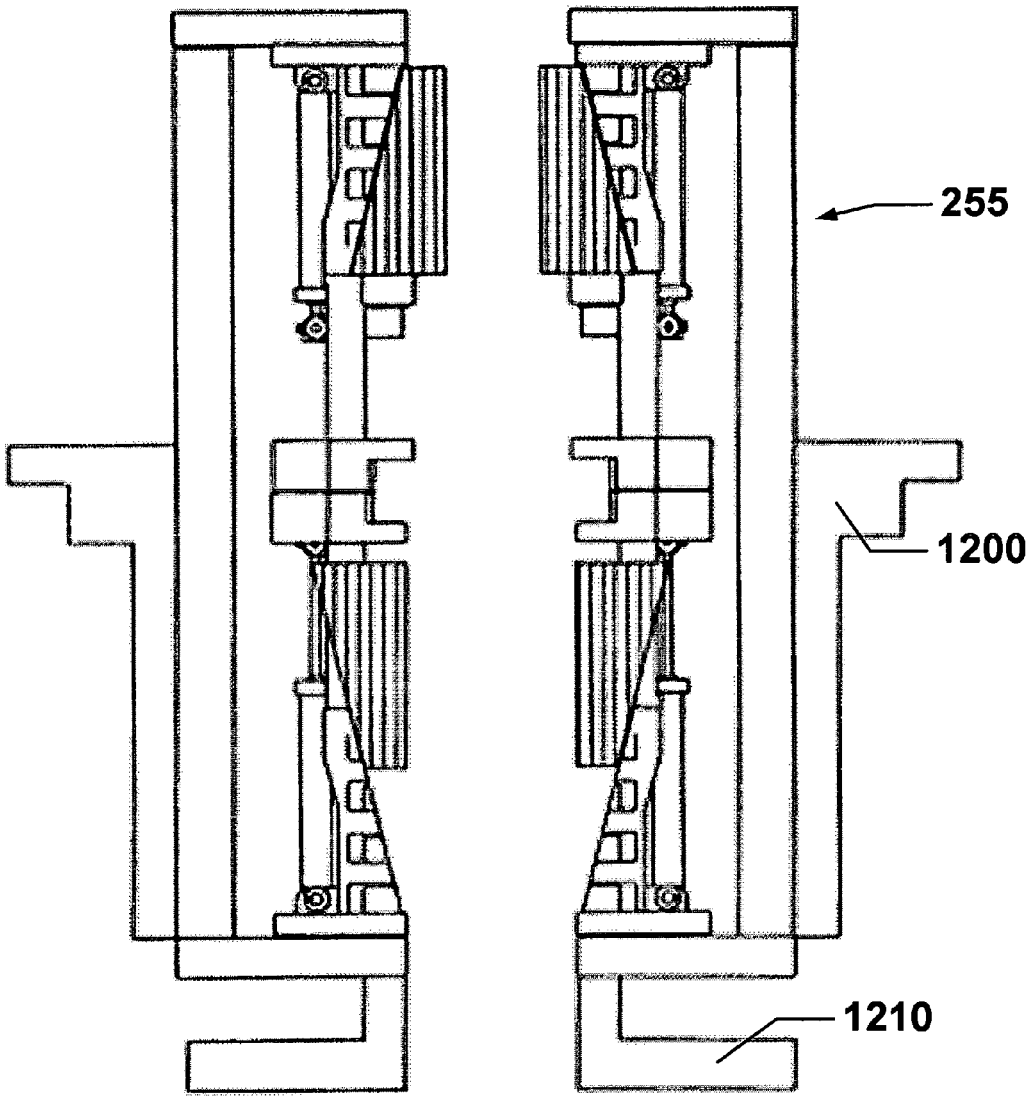
Figure 13:
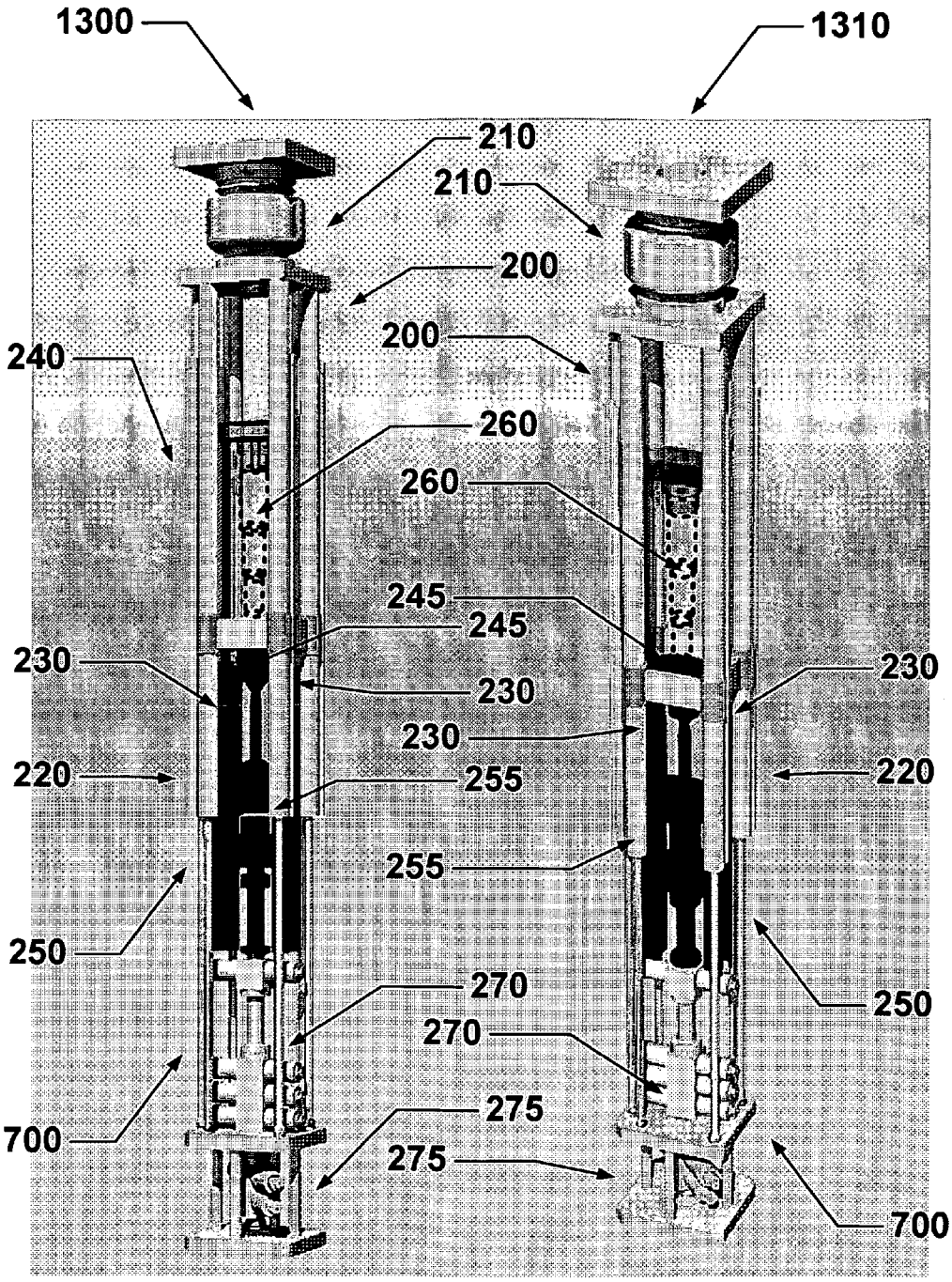

Consequently, a more complete understanding of the present disclosure and advantages thereof may be acquired by referring to the following description taken in conjunction with the accompanying drawings, in which the leftmost significant digit(s) in the reference numerals denote(s) the first figure in which the respective reference numerals appear, wherein:

FIG. 1 schematically illustrates a conventional motion compensated system using a drill rig's own compensation system;

FIG. 2 schematically illustrates a heave compensated hydraulic workover device and system according to various exemplary embodiments;

FIG. 3 schematically illustrates a hydraulic tensioning cylinder system useful in the heave compensated hydraulic workover device and system shown in FIG. 2;

FIG. 4 schematically illustrates a horizontal cross-sectional view of a manifold useful in the hydraulic tensioning cylinder system shown in FIG. 3 taken along line 4-4;

FIG. 5 schematically illustrates a vertical cross-sectional view of a manifold and upper blind ends of tensioning cylinders and upper portions of transfer tubing useful in the hydraulic tensioning cylinder system shown in FIG. 3 taken along line 5-5 of FIG. 4;

FIG. 6 schematically illustrates another vertical cross-sectional view of a manifold useful in the hydraulic tensioning cylinder system shown in FIG. 3 taken along line 6-6 of FIG. 4;

FIG. 7 schematically illustrates an exploded vertical cross-sectional view (indicated by the phantom circle 7 in FIG. 5) of a radial fluid band section in the manifold useful in the hydraulic tensioning cylinder system shown in FIG. 3;

FIG. 8 schematically illustrates the hydraulic tensioning cylinder system shown in FIG. 3 disposed through and/or beneath a rig floor;

FIG. 9 schematically illustrates a heave compensated hydraulic workover system according to various exemplary embodiments, shown in a fully collapsed condition suitable for rig up installation through the rig floor;

FIG. 10 schematically illustrates a heave compensated hydraulic workover device according to various exemplary embodiments, showing a telescoping guide system in a collapsed state;

FIG. 11 schematically illustrates the telescoping guide system shown in FIG. 10, showing the telescoping guide system in an extended state;

FIG. 12 schematically illustrates stationary/rotary slips useful in the heave compensated hydraulic workover device shown in FIG. 10;

FIG. 13 schematically illustrates two perspective views of the heave compensated hydraulic workover device and system shown in FIGS. 2 and 9.

Figure 14:
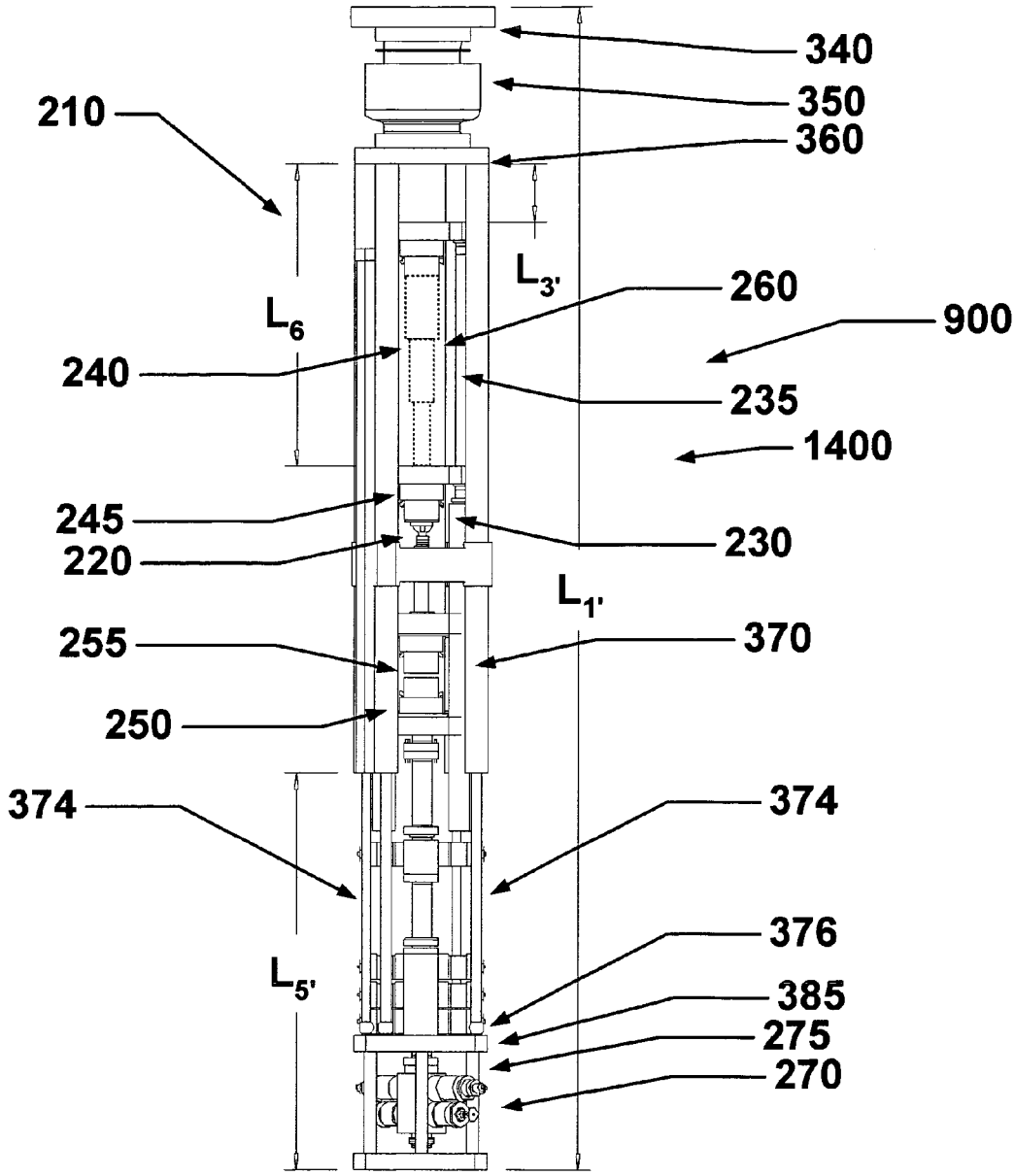
Figure 15:
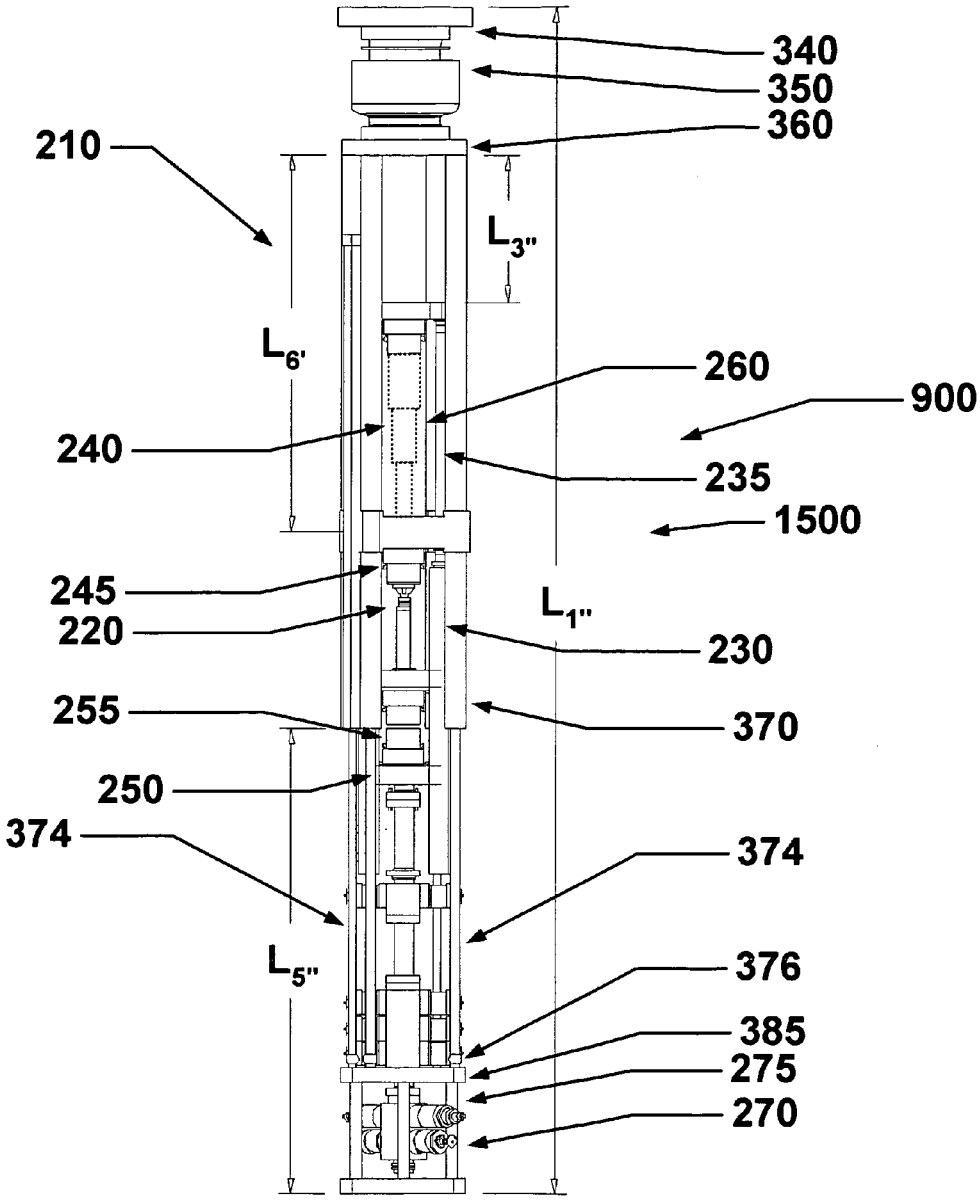
Figure 16:
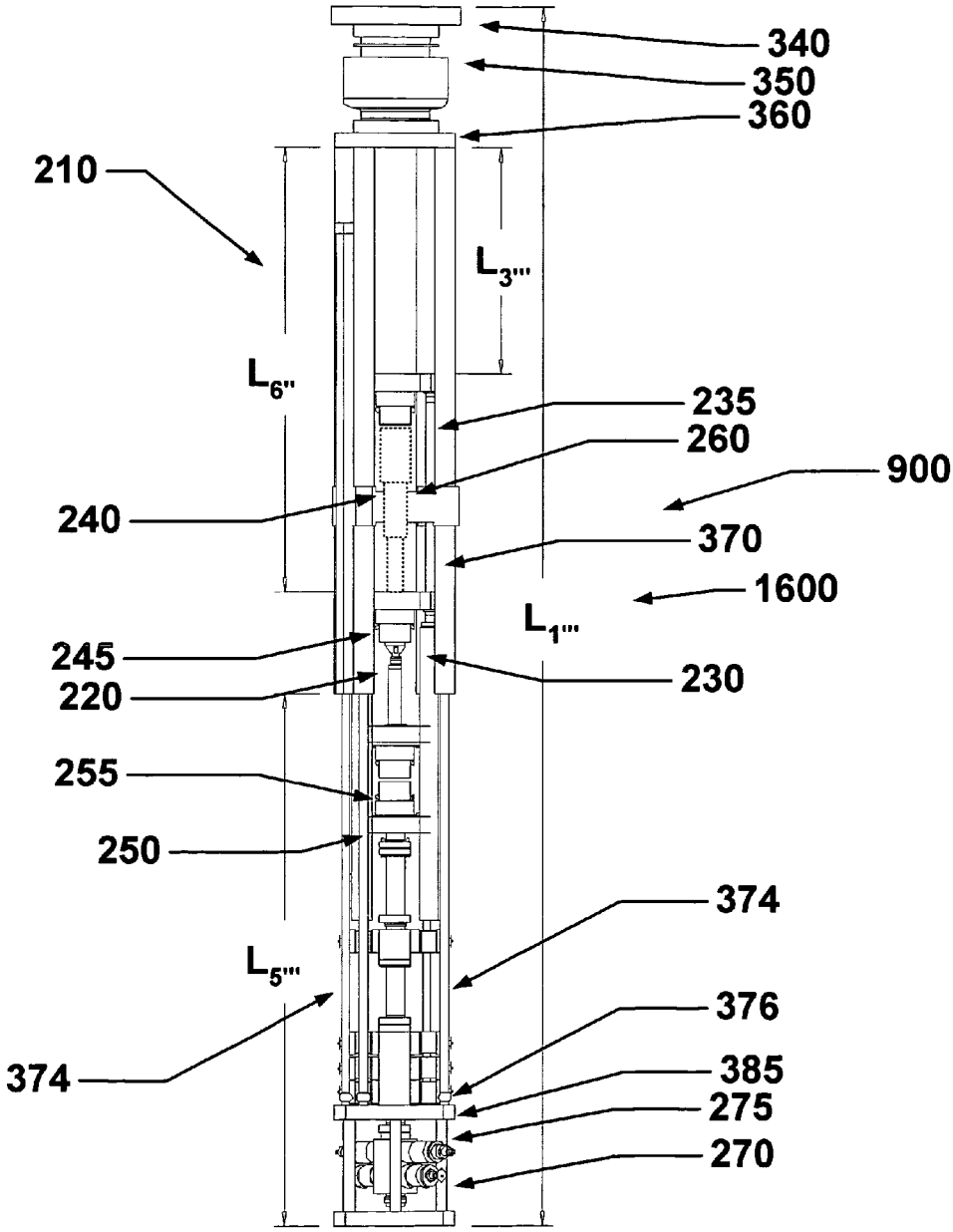
Figure 17:
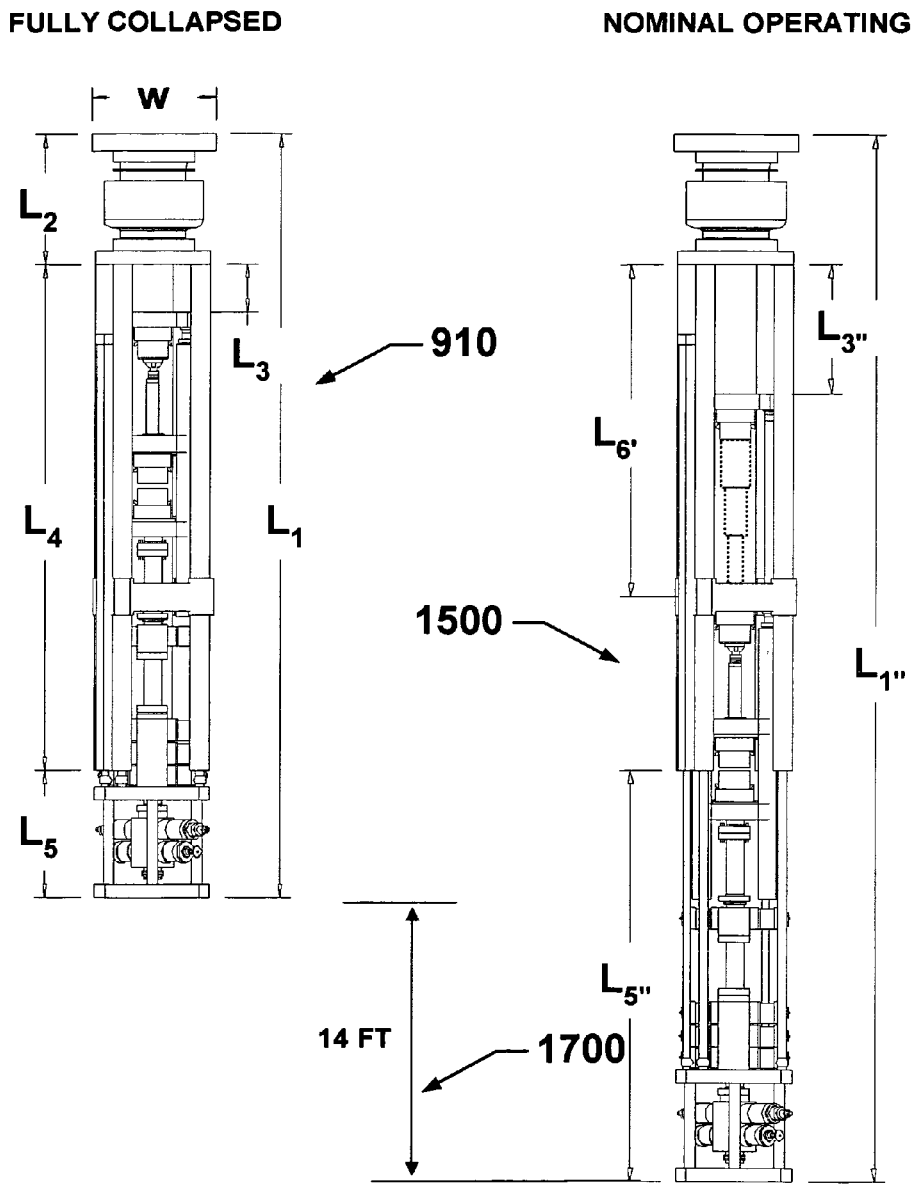
Figure 18:
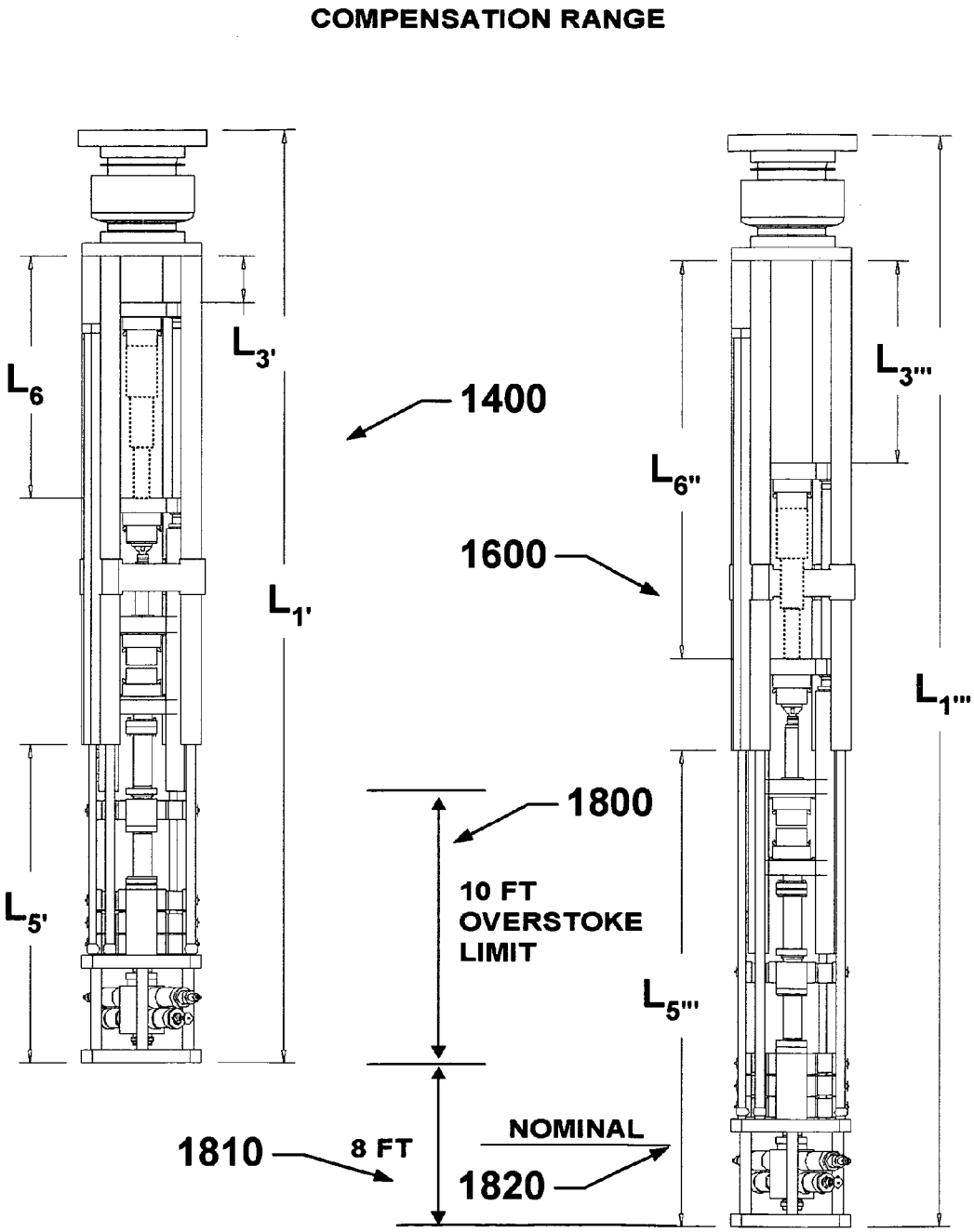
Figure 19:
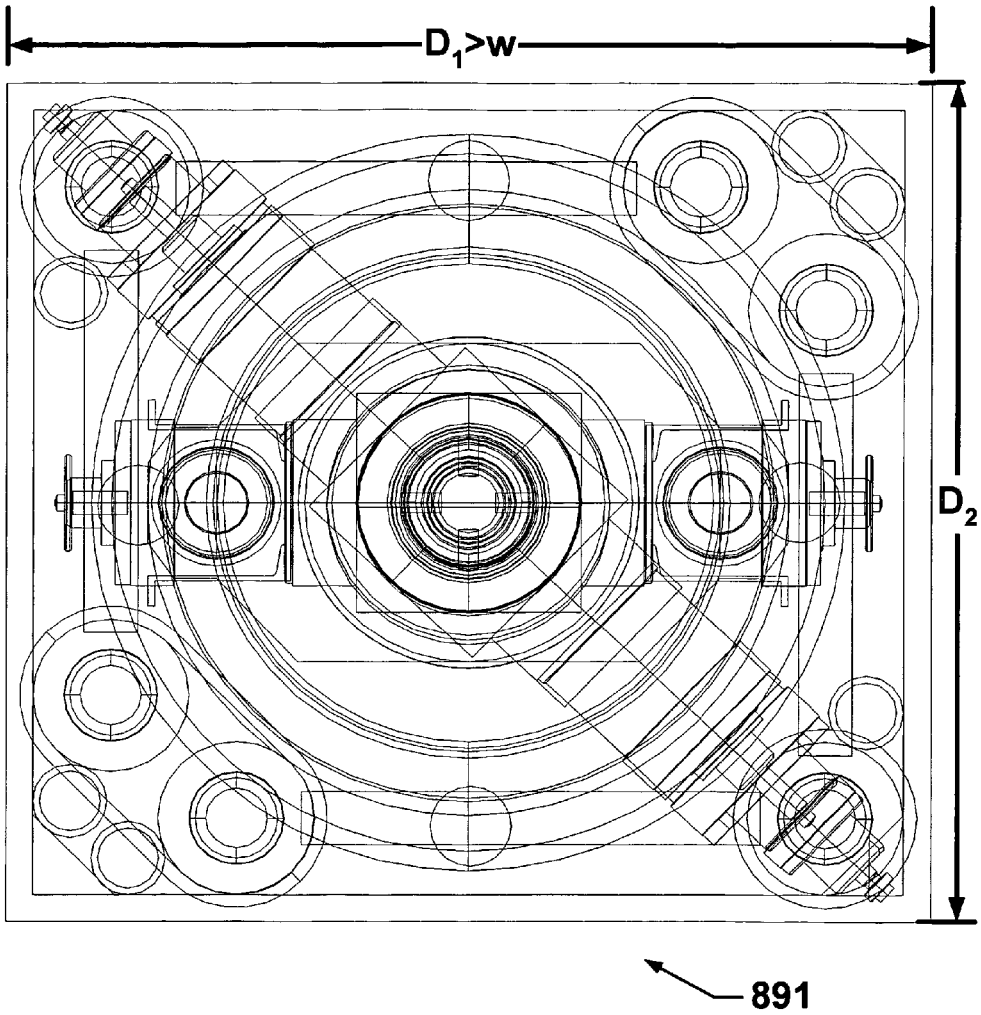
Figure 20:
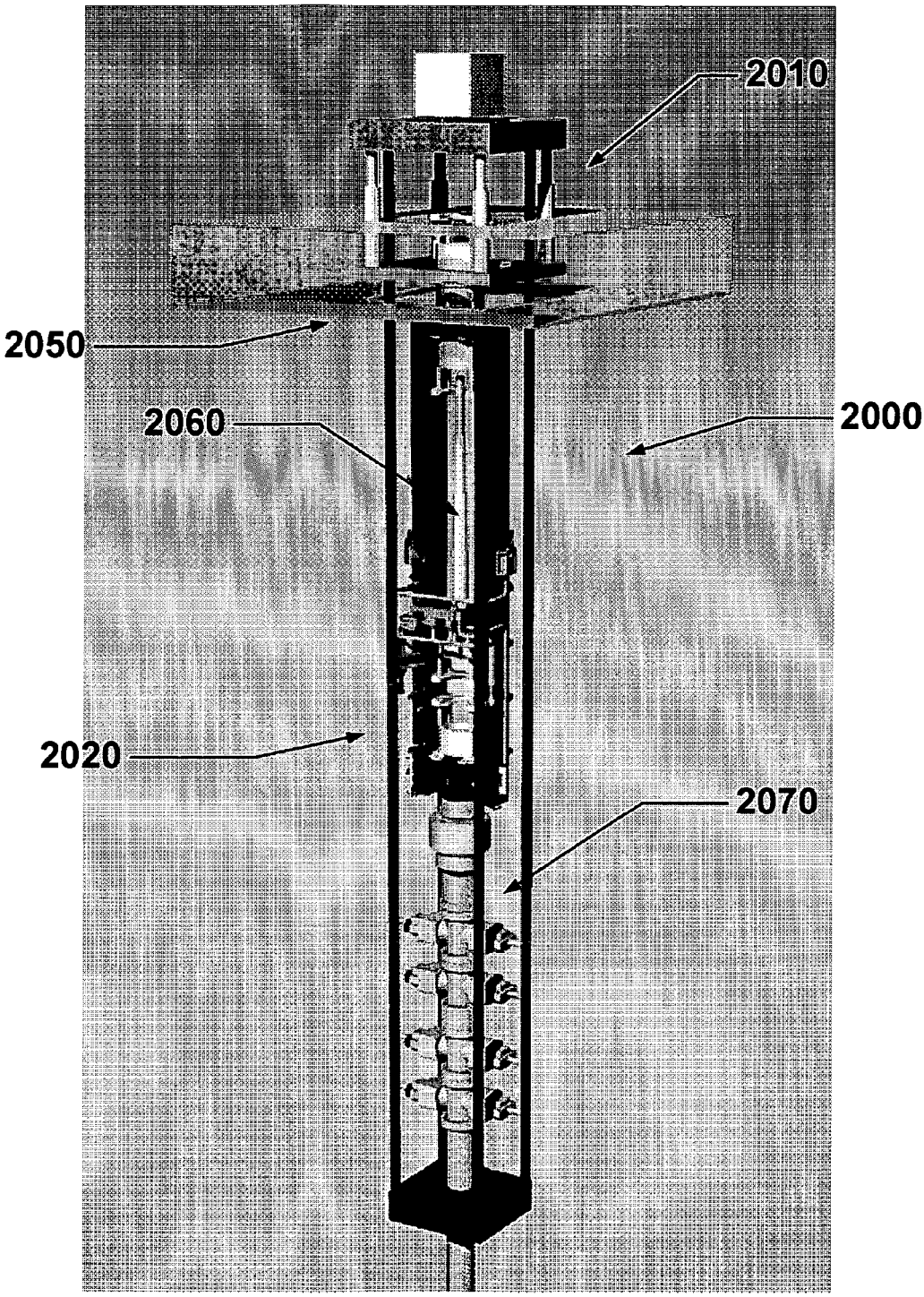
Figure 21:
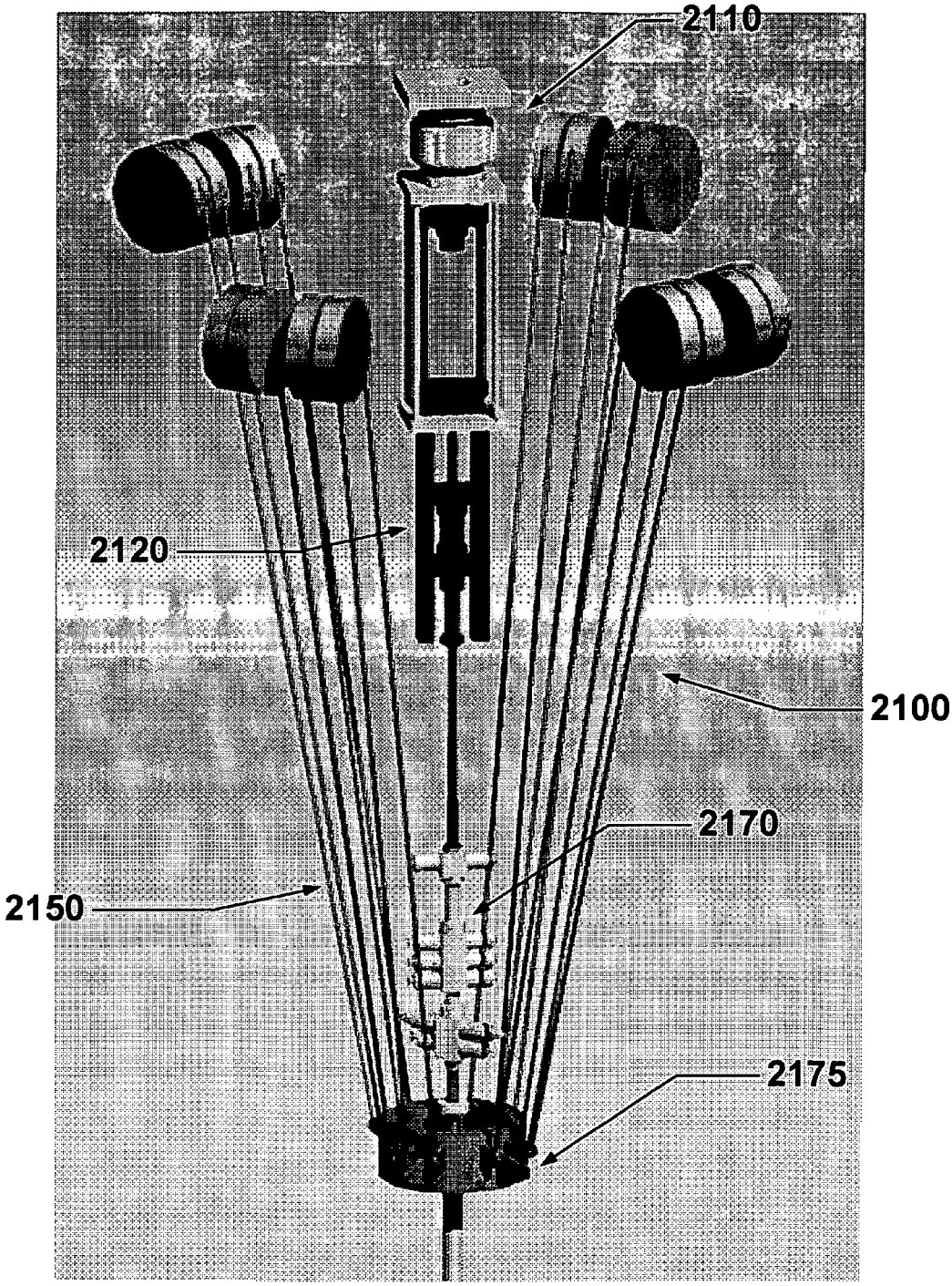
Figure 22:
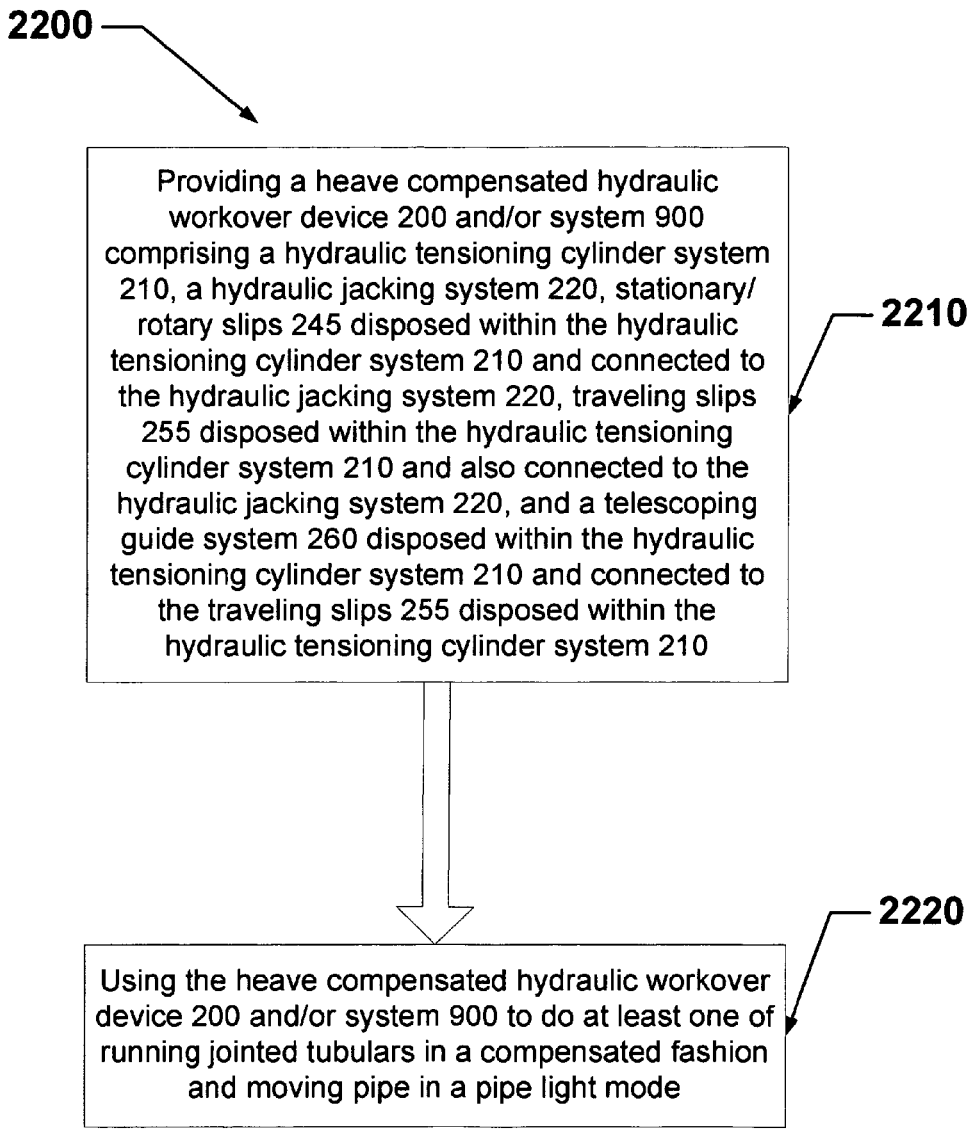
Figure 23:
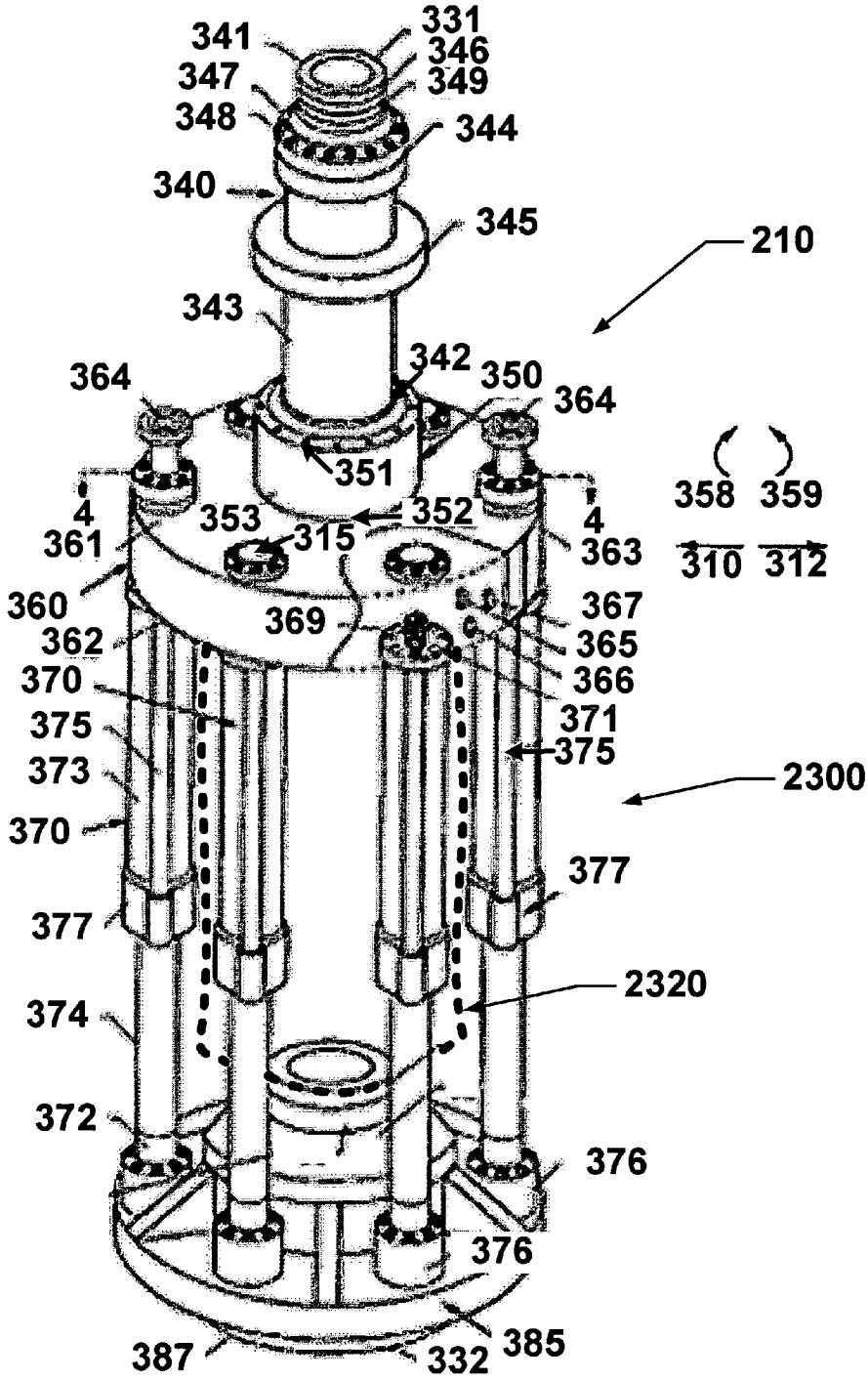
Figure 24:
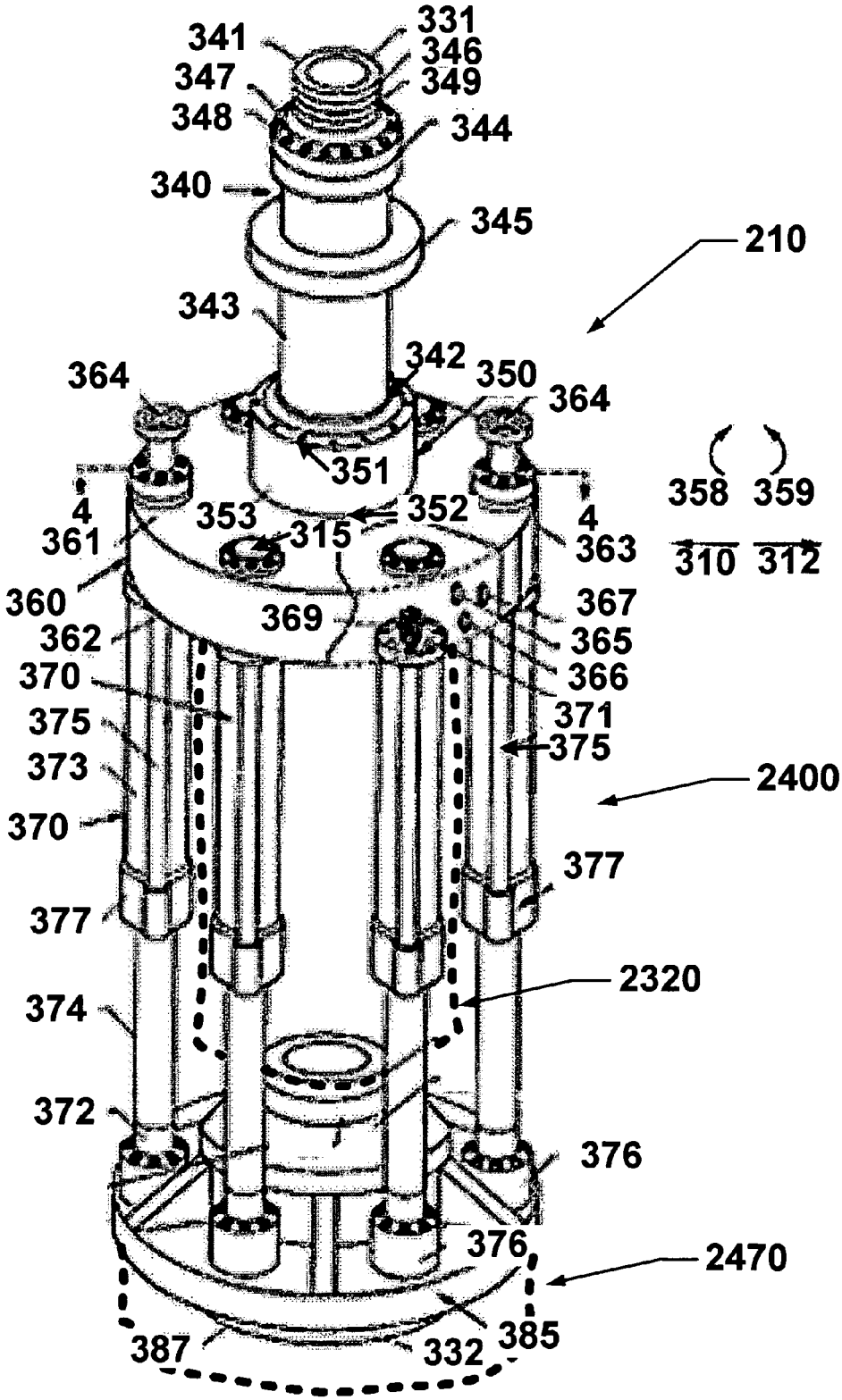
Figure 25:
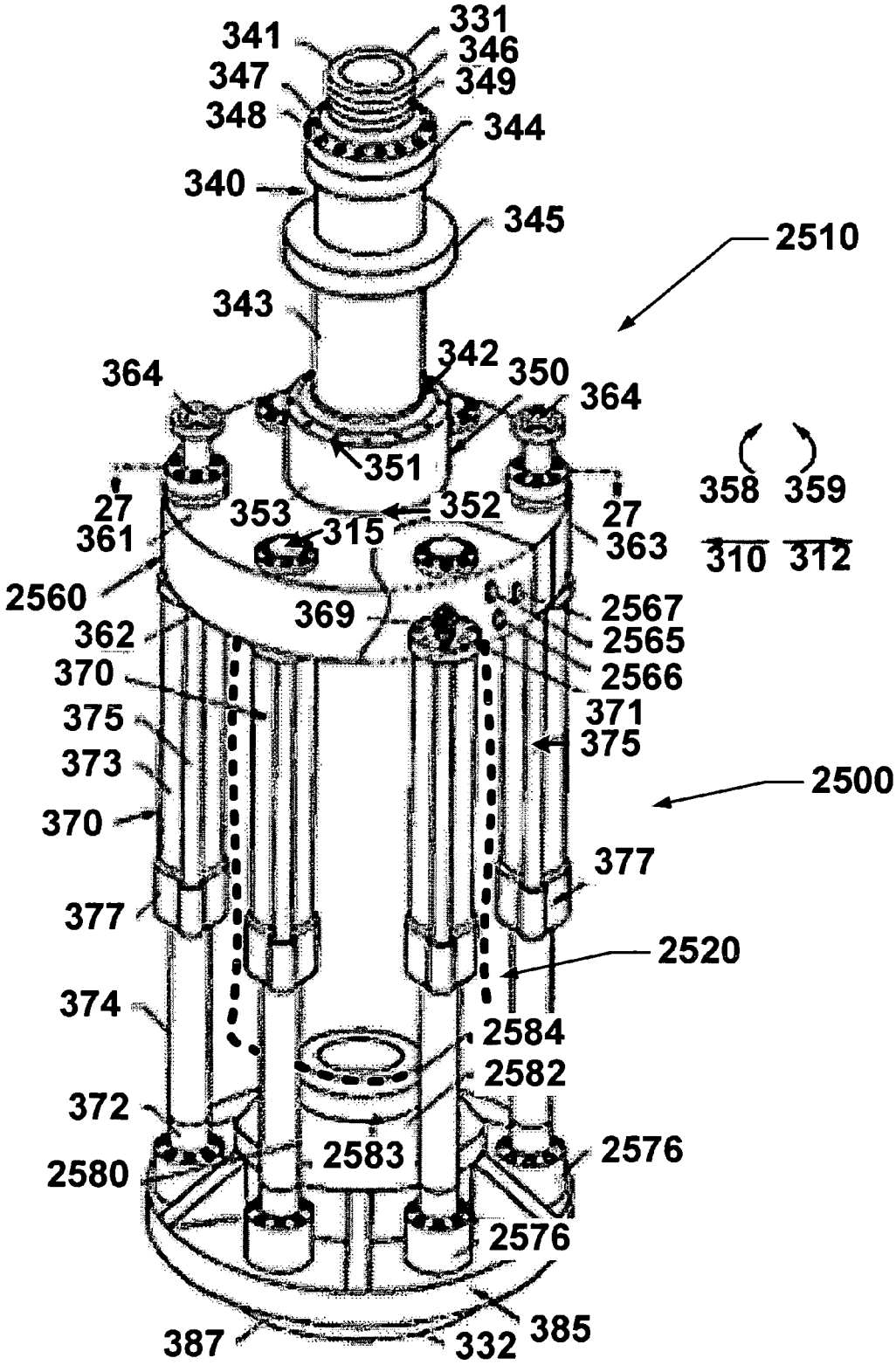
Figure 26:
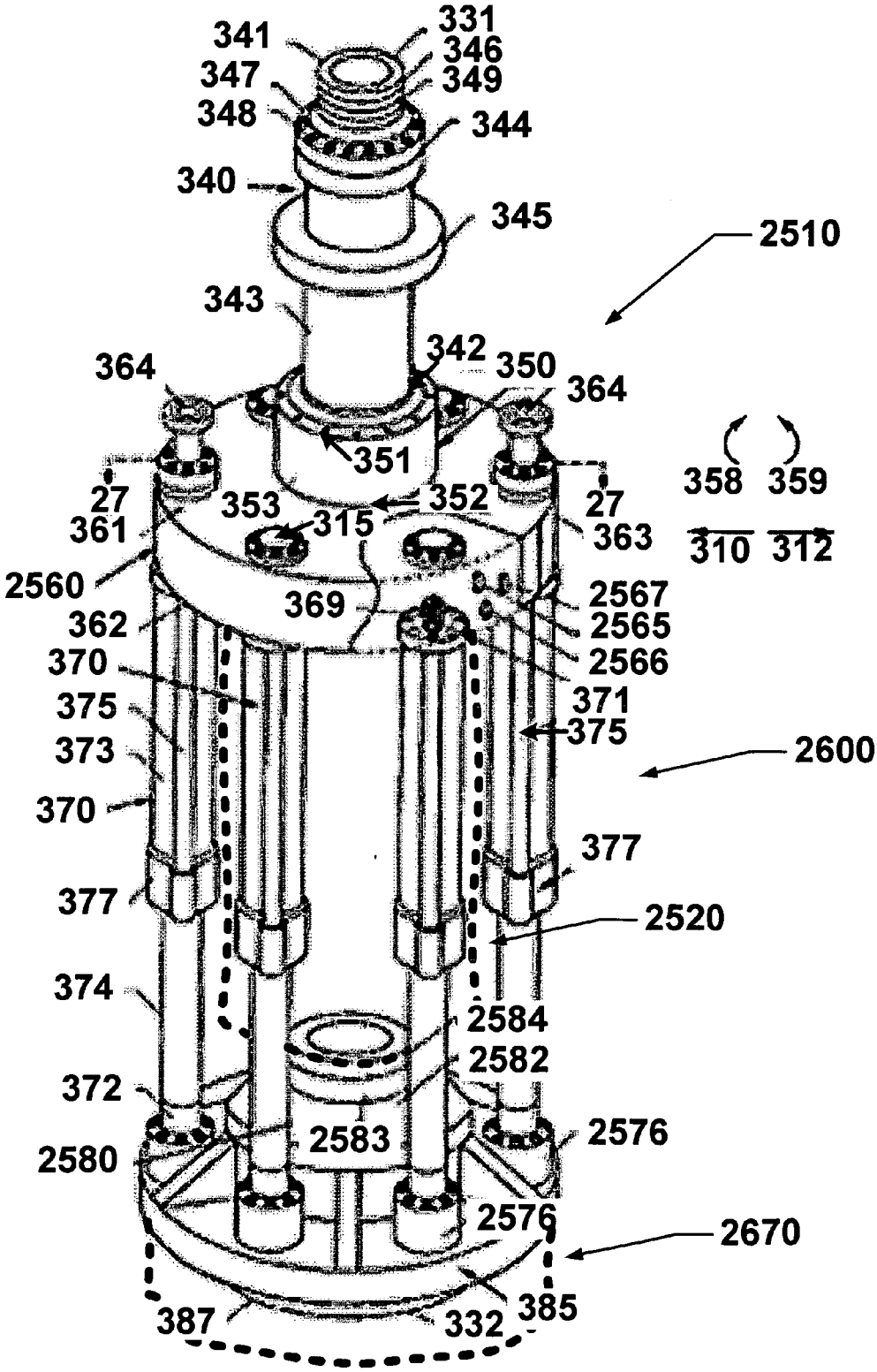
Figure 27:
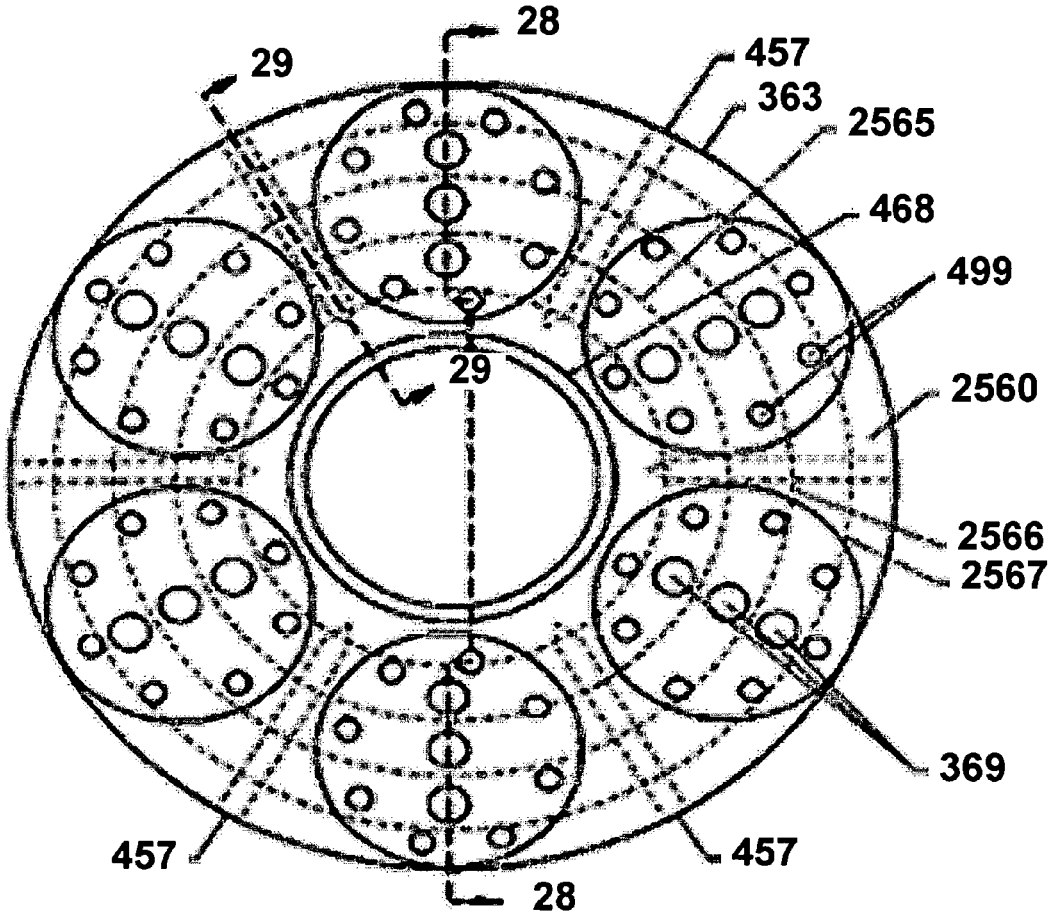
Figure 28:
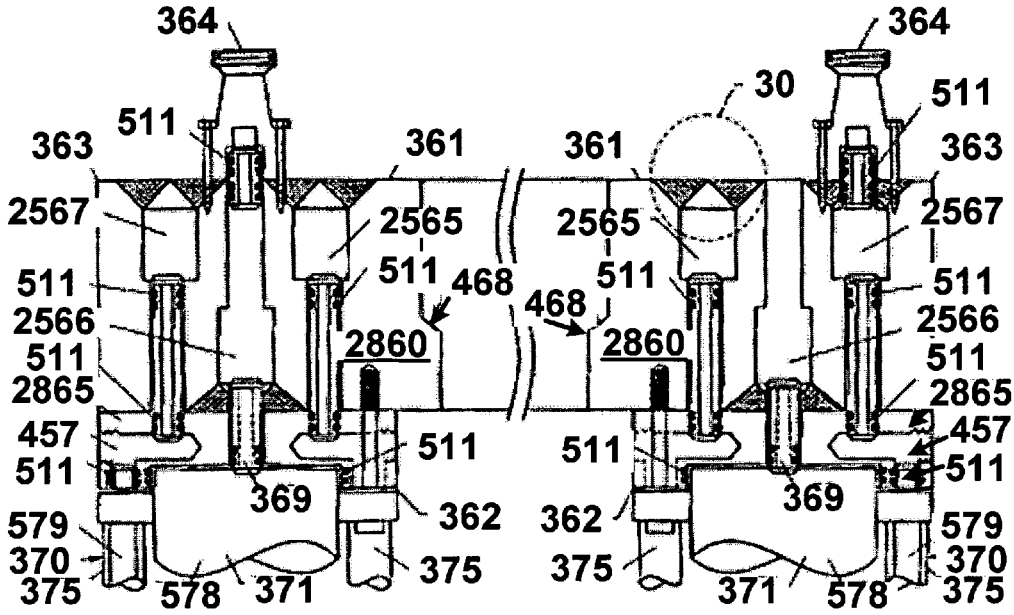
Figure 29:
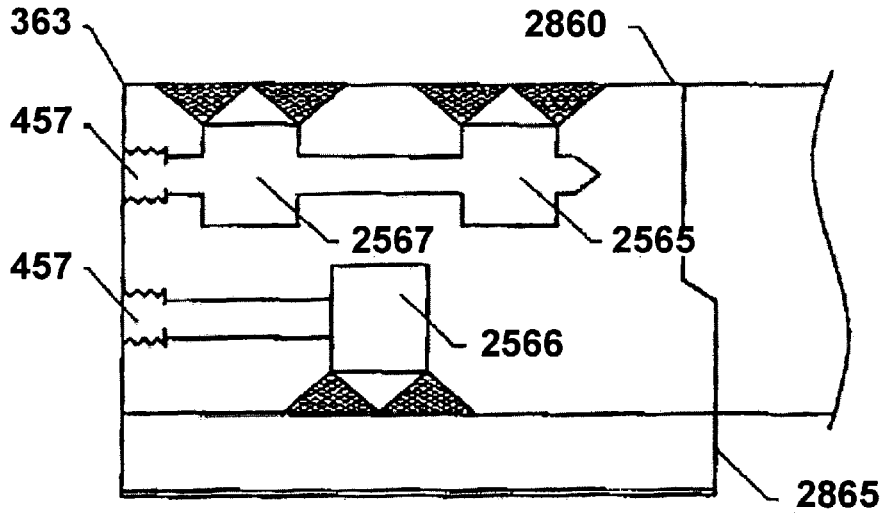
Figure 30:
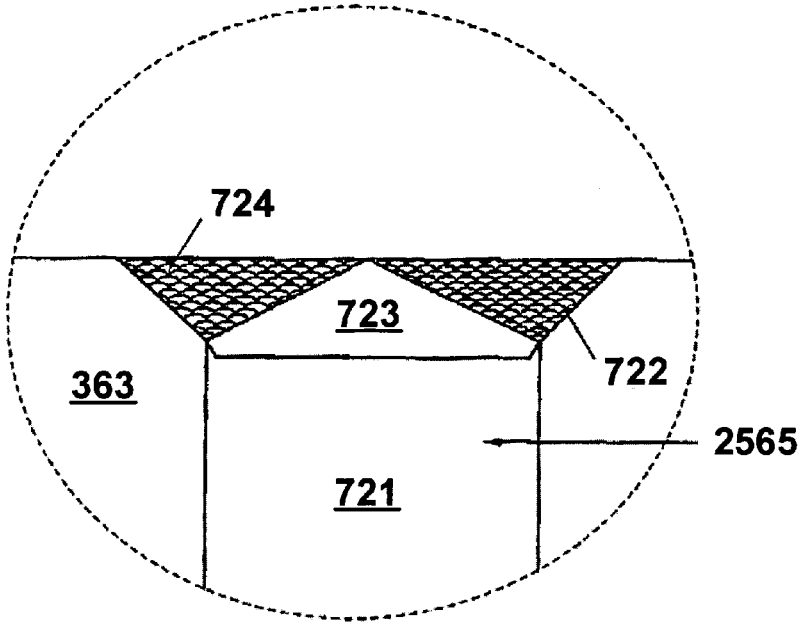
Figure 31:
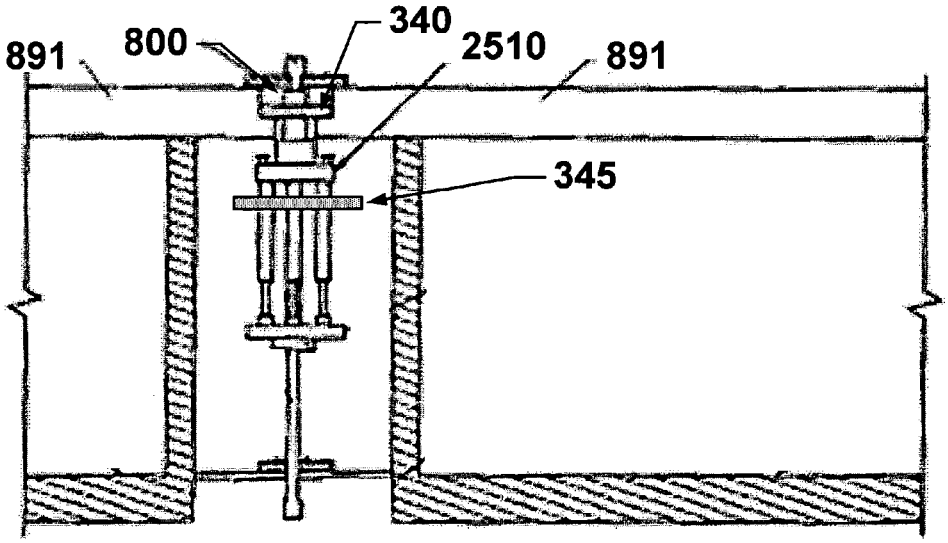
Figure 32:
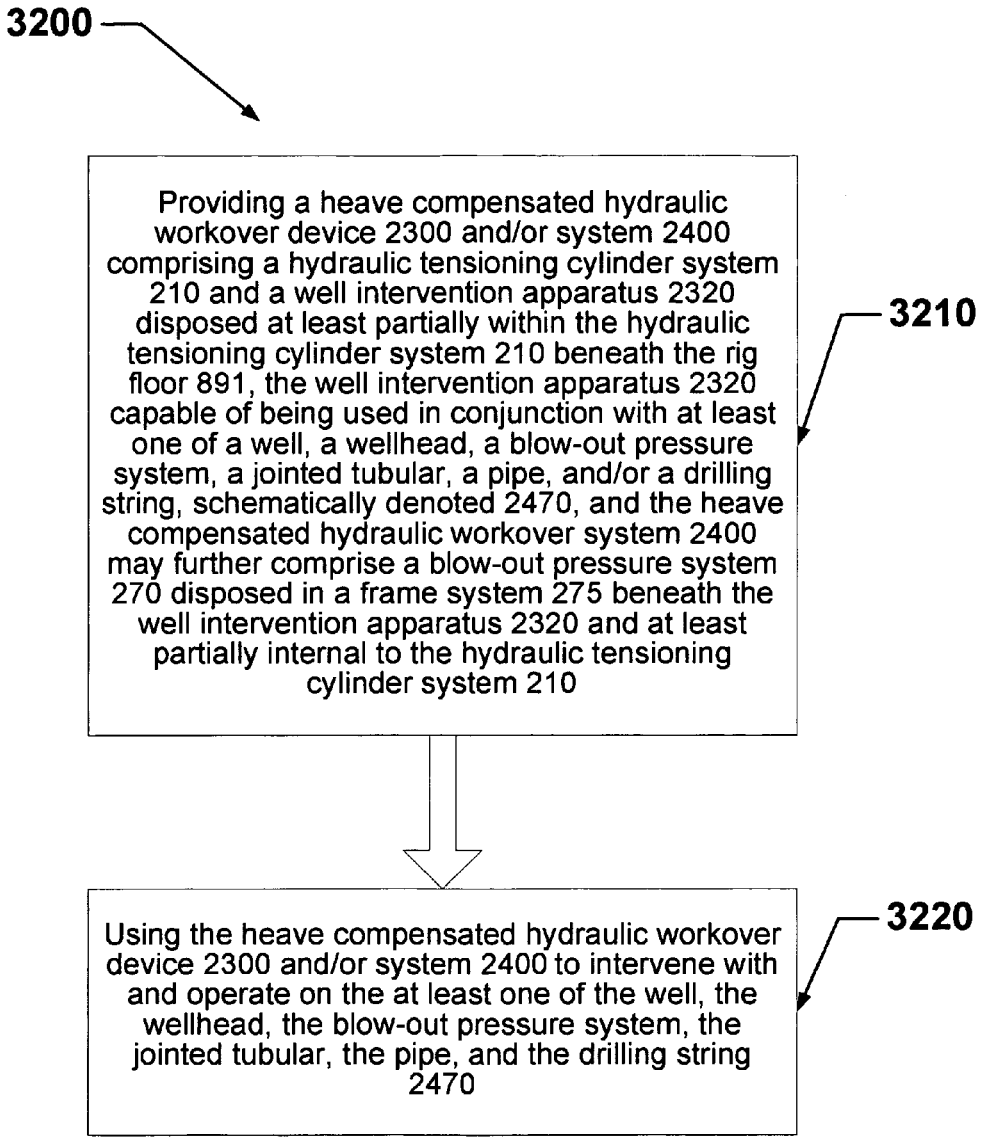
Figure 33:
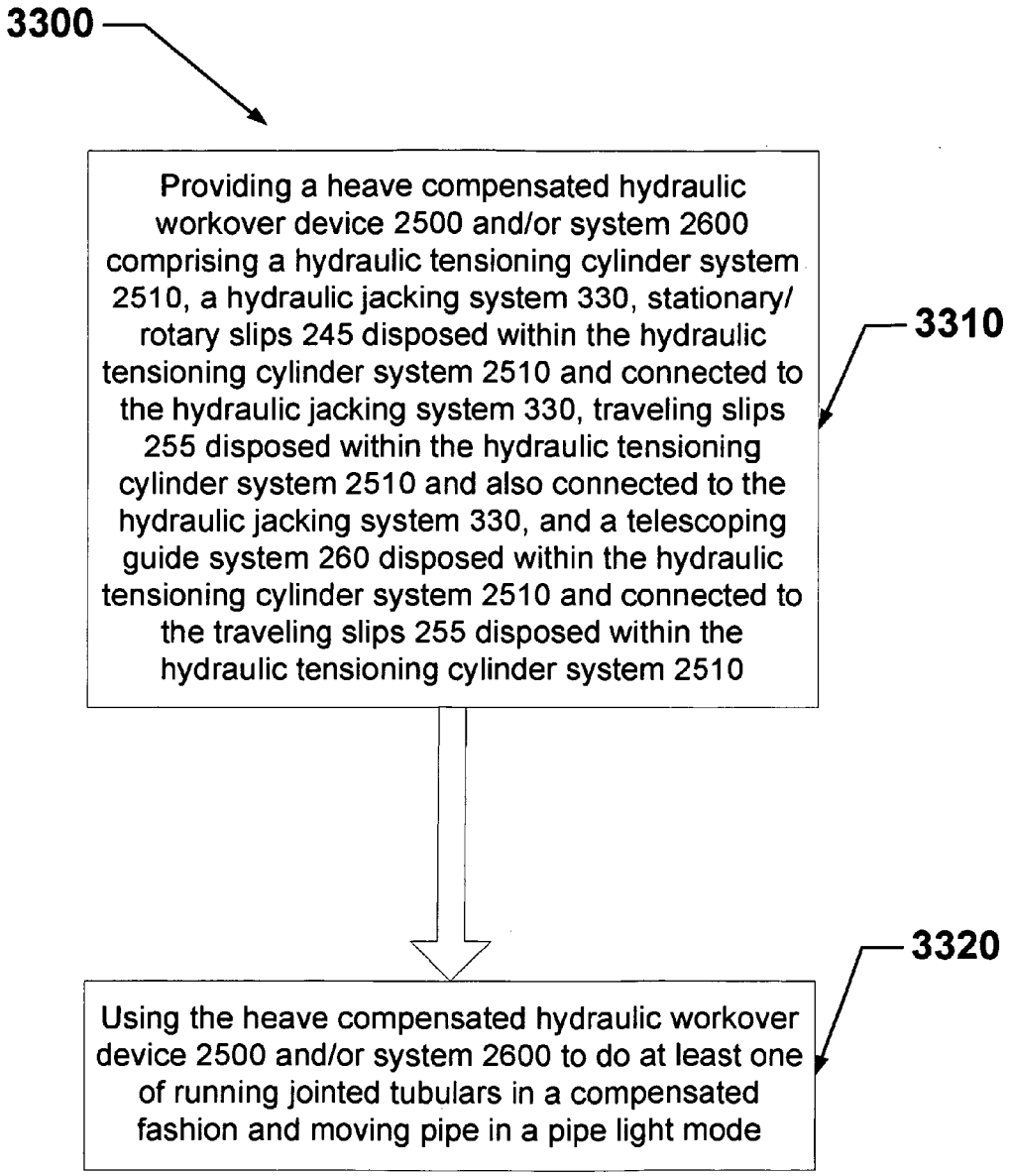
Figure 34:
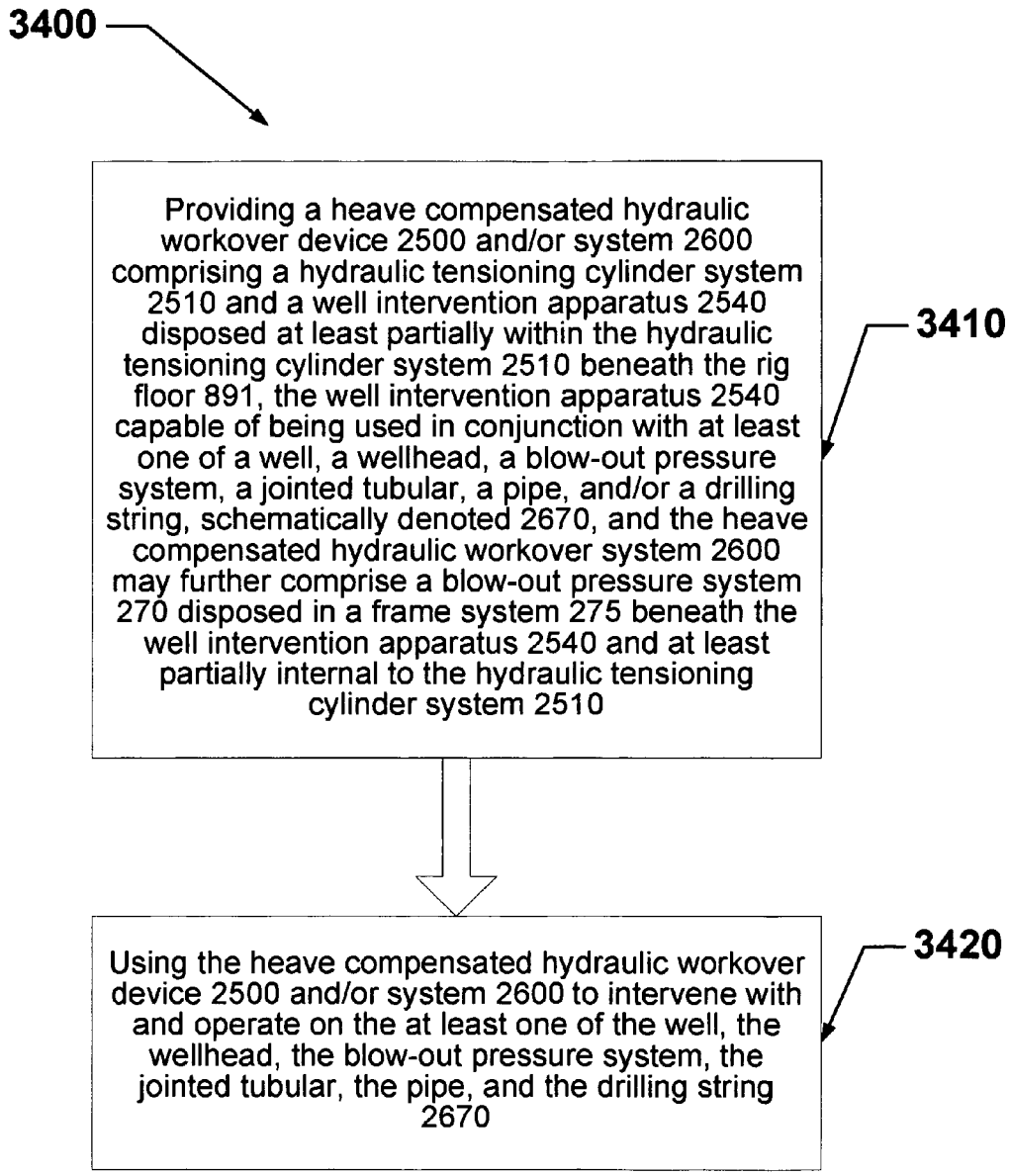

FIG. 14 schematically illustrates the heave compensated hydraulic workover system shown in FIG. 13 in a 4 foot (ft) "positive" heave condition;

FIG. 15 schematically illustrates the heave compensated hydraulic workover system shown in FIG. 13 in a mid-stroke or "nominal" heave condition;

FIG. 16 schematically illustrates the heave compensated hydraulic workover system shown in FIG. 13 in a 4 foot (ft) "negative" heave condition;

FIG. 17 schematically illustrates a side-by-side comparison between the fully collapsed condition of the heave compensated hydraulic workover system, as shown in FIG. 9, and the mid-stroke or "nominal" heave condition of the heave compensated hydraulic workover system, as shown in FIG. 15;

FIG. 18 schematically illustrates the compensation range, showing a side-by-side comparison between the 4 foot (ft) "positive" heave condition of the heave compensated hydraulic workover system, as shown in FIG. 14, and the 4 foot (ft) "negative" heave condition 1600 of the heave compensated hydraulic workover system, as shown in FIG. 16;

FIG. 19 schematically illustrates a top view of a portion of the rig floor through which the heave compensated hydraulic workover system, as shown in FIG. 9, may be inserted during rig up installation;

FIG. 20 schematically illustrates a heave compensated hydraulic workover system according to various alternative exemplary embodiments;

FIG. 21 schematically illustrates a heave compensated hydraulic workover system according to various alternative exemplary embodiments using a rig's existing riser tensioning system;

FIG. 22 schematically illustrates a method for running jointed tubulars in a compensated fashion and/or for moving pipe in a pipe light mode using the heave compensated hydraulic workover device and/or system as shown in FIG. 2;

FIG. 23 schematically illustrates a heave compensated hydraulic workover device according to various alternative exemplary embodiments;

FIG. 24 schematically illustrates a heave compensated hydraulic workover system according to various alternative exemplary embodiments;

FIG. 25 schematically illustrates a heave compensated hydraulic workover device according to various other alternative exemplary embodiments;

FIG. 26 schematically illustrates a heave compensated hydraulic workover system according to various other alternative exemplary embodiments;

FIG. 27 schematically illustrates a horizontal cross-sectional view of a manifold useful in the hydraulic tensioning cylinder device and system shown in FIGS. 25 and 26 taken along line 27-27;

FIG. 28 schematically illustrates a vertical cross-sectional view of a manifold and upper blind ends of tensioning cylinders and upper portions of transfer tubing useful in the hydraulic tensioning cylinder system shown in FIG. 25 taken along line 28-28 of FIG. 27;

FIG. 29 schematically illustrates another vertical cross-sectional view of a manifold useful in the hydraulic tensioning cylinder system shown in FIG. 25 taken along line 29-29 of FIG. 27;

FIG. 30 schematically illustrates an exploded vertical cross-sectional view (indicated by the phantom circle 30 in FIG. 28) of a radial fluid band in the manifold useful in the hydraulic tensioning cylinder system shown in FIG. 25;

FIG. 31 schematically illustrates the hydraulic tensioning cylinder system shown in FIG. 25 disposed through and/or beneath a rig floor;

FIG. 32 schematically illustrates a method for intervening with and operating on at least one of a well, a wellhead, a blow-out pressure system, a jointed tubular, a pipe, and a drilling string using the heave compensated hydraulic workover device and/or system as shown in FIGS. 23 and 24;

FIG. 33 schematically illustrates a method for running jointed tubulars in a compensated fashion and/or for moving pipe in a pipe light mode using the heave compensated hydraulic workover device and/or system as shown in FIGS. 25 and 26; and FIG. 34 schematically illustrates a method for intervening with and operating on at least one of a well, a wellhead, a blow-out pressure system, a jointed tubular, a pipe, and a drilling string using the heave compensated hydraulic workover device and/or system as shown in FIGS. 25 and 26.

DESCRIPTION

The present invention relates generally to offshore drilling and production operations, and, more particularly, to marine drilling workover/intervention tensioning and compensating devices and methodologies.

Illustrative embodiments of the present invention are described in detail below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of the present disclosure.

In various illustrative embodiments, as shown, for example, in FIGS. 2 and 3, a heave compensated hydraulic workover device 200 may comprise a hydraulic tensioning cylinder system 210 comprising at least one mandrel 340, at least one flexjoint swivel assembly 350 in communication with the at least one mandrel 340, and at least one manifold 360 in communication with the at least one flexjoint swivel assembly 350. As shown, for example, in FIG. 4, the at least one manifold 360 may have a plurality of first radial fluid band sections 366 and second radial fluid band sections 365 and 367.

The hydraulic tensioning cylinder system 210 may further comprise a plurality of tensioning cylinders 370 each having, as shown, for example, in FIG. 3, an upper blind end 371, a lower rod end 372, and at least one transfer tubing 375, the upper blind end 371 being in communication with a respective one of the plurality of first radial fluid band sections 366, the at least one transfer tubing being in communication with a respective one of the plurality of second radial fluid band sections 365 and 367, and the lower rod end being in communication with a bearing joint 376 that is not a flexjoint bearing, and a base 385 in communication with the bearing joint 376. As shown, for example, in FIG. 8, the hydraulic tensioning cylinder system 210 may be disposed through and/or beneath a rig floor 891 and adapted to be connected at the at least one mandrel 340 to the rig floor 891 through a rotary bushing slot 800 (e.g., through a rotary bushing slot that may or may not have a lock down capability) disposed in the rig floor 891. The plurality of tensioning cylinders 370 may provide a certain amount of redundancy, a useful safety feature in the unlikely event that one or more of the tensioning cylinders 370 might cease normal operation and/or otherwise become less than fully effective.

In various illustrative embodiments, the hydraulic tensioning cylinder system 210 may be capable of lifting with, and/or sustaining, forces in a range of about 200,000 pounds (lbs) to about 1,500,000 pounds (lbs). In various particular illustrative embodiments, the hydraulic tensioning cylinder system 210 may be capable of lifting with, and/or sustaining, forces of about 400,000 pounds (lbs), 800,000 pounds (lbs), and/or 1,200,000 pounds (lbs), for example. In various illustrative embodiments, the hydraulic tensioning cylinder system 210 may be capable of moving with a speed in a range of about 1 foot per second (ft/s) to about 5 feet per second (ft/s). In various particular illustrative embodiments, the hydraulic tensioning cylinder system 210 may be capable of moving with a speed of about 3 feet per second (ft/s).

In various illustrative embodiments, as shown, for example, in FIGS. 2, 9 and 10, the heave compensated hydraulic workover device 200 may further comprise a hydraulic jacking system 220 comprising a plurality of hydraulic cylinders 230. In various illustrative embodiments, the hydraulic jacking system 220 may comprise as few as about two hydraulic cylinders 230, and in various other illustrative embodiments, the hydraulic jacking system 220 may comprise as many as about six hydraulic cylinders 230. In various particular illustrative embodiments, the hydraulic jacking system 220 may comprise about four hydraulic cylinders 230. Moreover, in various illustrative embodiments, one or more of the plurality of hydraulic cylinders 230 may have a spline torque tube disposed therein to provide a torque path to a rotary table (not shown) that may be disposed in the rig floor 891, for example.

The hydraulic jacking system 220 may have a first portion 240 and a second portion 250. The hydraulic jacking system 220 may be disposed within the hydraulic tensioning cylinder system 210 beneath the rig floor 891. In various illustrative embodiments, the hydraulic jacking system 220 may be capable of lifting with forces in a range of about 120,000 pounds (lbs) to about 600,000 pounds (lbs), and of snubbing (or pushing) with forces in a range of about 60,000 pounds (lbs) to about 300,000 pounds (lbs). In various particular illustrative embodiments, the hydraulic tensioning cylinder system 210 may be capable of lifting with a force of about 200,000 pounds (lbs), and of snubbing (or pushing) with a forces of about 100,000 pounds (lbs), for example.

In various illustrative embodiments, as shown, for example, in FIGS. 2 and 10, the heave compensated hydraulic workover device 200 may further comprise stationary/rotary slips 255 disposed within the hydraulic tensioning cylinder system 210 and connected to either the first portion 240 (as shown in FIG. 10, for example) or the second portion 250 (as shown in FIGS. 2 and 9, for example) of the hydraulic jacking system 220. The heave compensated hydraulic workover device 200 may also comprise traveling slips 245 disposed within the hydraulic tensioning cylinder system 210 and connected to either the first portion 240 (as shown in FIGS. 2 and 9, for example) or the second portion 250 (as shown in FIG. 10, for example) of the hydraulic jacking system 220, whichever of the first portion 240 and the second portion 250 to which the stationary/rotary slips 255 are not connected. As shown in FIG. 10, for example, the traveling slips 245 may be connected to the second portion 250 of the hydraulic jacking system 220 by being connected through a rotary swivel 1000.

In various illustrative embodiments, as shown, for example, in FIGS. 2, 10 and 11, the heave compensated hydraulic workover device 200 may also comprise a telescoping guide system 260 disposed within the hydraulic tensioning cylinder system 210 and connected to the traveling slips 245 disposed within the hydraulic tensioning cylinder system 210. FIG. 10 shows the telescoping guide system 260 in a collapsed state, and FIG. 11 shows the telescoping guide system 260 in an extended state, for example. The telescoping guide system 260 may be used to accommodate a disconnect with short tensioning cylinders 370.

In various illustrative embodiments, as shown, for example, in FIG. 9, a heave compensated hydraulic workover system 900 may comprise the heave compensated hydraulic workover device 200, as described above, and a blow-out pressure system 270 disposed in a frame system 275 beneath the hydraulic jacking system 220 and at least partially internal to the hydraulic tensioning cylinder system 210. The base 385 of the hydraulic tensioning cylinder system 210 may be incorporated into a portion of the frame system 275. The heave compensated hydraulic workover system 900 is shown in FIG. 9 in a fully collapsed condition 910 suitable for rig up installation through the rig floor 891.

In various illustrative embodiments, as shown, for example, in FIGS. 10 and 11, the heave compensated hydraulic workover device 200 may comprise the stationary/rotary slips 255 having an upper portion 1010 and a lower portion 1020, the stationary/rotary slips 255 adapted to be connected to the rig floor 891 through a Kelly (or rotary) bushing slot (or lock down) 1025 slot disposed in the rig floor 891. As shown in FIG. 12, for example, the stationary/rotary slips 255 bowl may have a rotary bushing insert flange 1200 adapted to be connected to the rig floor 891 through a rotary bushing lock down 1025 slot disposed in the rig floor 891.

In various illustrative embodiments, as shown, for example, in FIGS. 10 and 11, the heave compensated hydraulic workover device 200 may further comprise the hydraulic jacking system 220 comprising a plurality of hydraulic cylinders 230, as described above. The hydraulic jacking system 220 may have the first portion 240 connected to the stationary/rotary slips 255, and the second portion 250 connected to the rotary swivel 1000. As shown in FIG. 12, for example, the stationary/rotary slips 255 bowl may have a bottom flange 1210 adapted to be connected to the first portion 240 of the hydraulic jacking system 220. The hydraulic jacking system 220 may be disposed beneath the rig floor 891.

In various illustrative embodiments, as shown, for example, in FIGS. 10 and 11, the heave compensated hydraulic workover device 200 may also comprise the hydraulic tensioning cylinder system 210, as described above, disposed external to the hydraulic jacking system 220 and connected to the second portion 250 of the hydraulic jacking system 220. In various alternative illustrative embodiments, one or more manual screw jacks may be used instead of one or more of the tensioning cylinders 370.

In various illustrative embodiments, as shown, for example, in FIGS. 10 and 11, the heave compensated hydraulic workover device 200 may additionally comprise the rotary swivel 1000 disposed within the hydraulic tensioning cylinder system 210 and connected to the second portion 250 of the hydraulic jacking system 220, as described above. The traveling slips 245 may also be disposed within the hydraulic tensioning cylinder system 210 and connected to the rotary swivel 1000. The telescoping guide system 260 may be disposed within the hydraulic tensioning cylinder system 210 beneath the traveling slips 245 and connected to the traveling slips 245. Hydraulic tongs 1030 may be disposed above hydraulic back-ups 1040 disposed above the stationary/rotary slips 255.

In various illustrative embodiments, as shown, for example, in FIG. 13, the heave compensated hydraulic workover device 200 and/or the heave compensated hydraulic workover system 900 may be shown in perspective views. The heave compensated hydraulic workover device 200 and/or the heave compensated hydraulic workover system 900 is shown a in perspective view from below at 1300. The heave compensated hydraulic workover device 200 and/or the heave compensated hydraulic workover system 900 is shown in a perspective view from above at 1310.

In various particular illustrative embodiments, as shown, for example, in FIGS. 9 and 14-19, the heave compensated hydraulic workover system 900 may be shown in a range of various conditions and/or states expected during normal operation. The various particular illustrative embodiments disclosed in FIGS. 9 and 14-19, for example, are illustrative only, as the present invention may be modified and practiced in different but equivalent manners apparent to those skilled in the art having the benefit of the teachings herein. Furthermore, no limitations are intended to the details of construction or design herein shown, such as various dimensions of length and/or width, other than as described in the claims below. It is therefore evident that the various particular illustrative embodiments disclosed in FIGS. 9 and 14-19, for example, may be altered or modified and all such variations are considered within the scope and spirit of the present invention.

FIG. 9, for example, shows the heave compensated hydraulic workover system 900 in the fully collapsed condition 910 suitable for rig up installation through the rig floor 891. The mandrel 340 may have a width w in one direction, for example. As shown in FIG. 19, for example, showing an illustration of an available "footprint" on the rig floor 891, this width w for the mandrel 340 in one direction may be accommodated by a dimension $D_1$>w in one of two directions and/or a dimension $D_2$ that may satisfy the condition $D_2$>w in the other of the two directions.

The heave compensated hydraulic workover system 900 in the collapsed condition 910, suitable for rig up installation through the rig floor 891, may have an overall length $L_1$ in various particular illustrative embodiments, as shown, for example, in FIG. 9. There may be a length $L_2$ from the top portion of the mandrel 340 to the bottom portion of the manifold 360, which is also the top portion of the tensioning cylinders 370. There may be a length $L_3$ from the bottom portion of the manifold 360, which is also the top portion of the tensioning cylinders 370, to the first portion 240 (here also the top portion of the telescopic guide system 260) of the hydraulic jacking system 220. There may be a length $L_4$ of each of the tensioning cylinders 370. There may be a length $L_5$ from the bottom portion of the tensioning cylinders 370 to the bottom portion of the frame system 275.

FIG. 14, for example, shows the heave compensated hydraulic workover system 900 in a 4 foot (ft) "positive" heave condition 1400, wherein the overall length $L_{1'}$ of the heave compensated hydraulic workover system 900 in the 4 foot (ft) "positive" heave condition 1400 may be about $L_{1'}=L_1+10$ feet (ft), for example. There may be a length $L_6$ from the bottom portion of the manifold 360, which is also the top portion of the tensioning cylinders 370, to the top portion of the traveling slips 245 (here also the bottom portion of the telescopic guide system 260). The length $L_{3'}$ from the bottom portion of the manifold 360, which is also the top portion of the tensioning cylinders 370, to the first portion 240 (here also the top portion of the telescopic guide system 260) of the hydraulic jacking system 220 may be substantially the same as the length $L_3$ in the collapsed condition 910 shown in FIG. 9. The rods 235 of each of the hydraulic cylinders 230 may have been extended by about 10 feet (ft), for example. The length $L_{5'}$ from the bottom portion of the tensioning cylinders 370 to the bottom portion of the frame system 275 in the 4 foot (ft) "positive" heave condition 1400 may be about $L_{5'}=L_5+10$ feet (ft), for example. The rods 374 of each of the tensioning cylinders 370 may have been extended by about 10 feet (ft), for example.

FIG. 15, for example, shows the heave compensated hydraulic workover system 900 in a mid-stroke or "nominal" heave condition 1500, wherein the overall length $L_{1''}$ of the heave compensated hydraulic workover system 900 in the mid-stroke or "nominal" heave condition 1500 may be about $L_{1''}=L_{1'}+4$ feet (ft), for example. The length $L_{6'}$ from the bottom portion of the manifold 360, which is also the top portion of the tensioning cylinders 370, to the top portion of the traveling slips 245 (here also the bottom portion of the telescopic guide system 260) may be about $L_{6'}=L_6+4$ feet (ft), for example. The length $L_{3''}$ from the bottom portion of the manifold 360, which is also the top portion of the tensioning cylinders 370, to the first portion 240 (here also the top portion of the telescopic guide system 260) of the hydraulic jacking system 220 may be about $L_{3''}=L_{3'}+4$ feet (ft), for example. The rods 235 of each of the hydraulic cylinders 230 may have been extended by about 10 feet (ft), for example, or about the same as in the 4 foot (ft) "positive" heave condition 1400 shown in FIG. 14. The length $L_{5''}$ from the bottom portion of the tensioning cylinders 370 to the bottom portion of the frame system 275 in the mid-stroke or "nominal" heave condition 1500 may be about $L_{5''}=L_{5'}+4$ feet (ft), for example. The rods 374 of each of the tensioning cylinders 370 may have been extended by about 14 feet (ft), for example.

FIG. 16, for example, shows the heave compensated hydraulic workover system 900 in a 4 foot (ft) "negative" heave condition 1600, wherein the overall length $L_{1'''}$ of the heave compensated hydraulic workover system 900 in the 4 foot (ft) "negative" heave condition 1600 may be about $L_{1'''}=L_{1''}+4$ feet (ft), for example. The length $L_{6''}$ from the bottom portion of the manifold 360, which is also the top portion of the tensioning cylinders 370, to the top portion of the traveling slips 245 (here also the bottom portion of the telescopic guide system 260) may be about $L_{6''}=L_{6'}+4$ feet (ft), for example. The length $L_{3'''}$ from the bottom portion of the manifold 360, which is also the top portion of the tensioning cylinders 370, to the first portion 240 (here also the top portion of the telescopic guide system 260) of the hydraulic jacking system 220 may be about $L_{3'''}=L_{3''}+4$ feet (ft), for example. The rods 235 of each of the hydraulic cylinders 230 may have been extended by about 10 feet (ft), for example, or about the same as in both the 4 foot (ft) "positive" heave condition 1400 shown in FIG. 14 and the mid-stroke or "nominal" heave condition 1500 shown in FIG. 15. The length $L_{5'''}$ from the bottom portion of the tensioning cylinders 370 to the bottom portion of the frame system 275 in the mid-stroke or "nominal" heave condition 1500 may be about $L_{5'''}=L_{5''}+4$ feet (ft), for example. The rods 374 of each of the tensioning cylinders 370 may have been extended by about 18 feet (ft), for example.

FIG. 17, for example, shows a side-by-side comparison between the fully collapsed condition 910 of the heave compensated hydraulic workover system 900, as shown in FIG. 9, and the mid-stroke or "nominal" heave condition 1500 of the heave compensated hydraulic workover system 900, as shown in FIG. 15, showing a difference 1700 in overall length ($L_{1''}-L_1$) of about 14 feet (ft), for example. FIG. 18, for example, illustrates the compensation range, showing a side-by-side comparison between the 4 foot (ft) "positive" heave condition 1400 of the heave compensated hydraulic workover system 900, as shown in FIG. 14, and the 4 foot (ft) "negative" heave condition 1600 of the heave compensated hydraulic workover system 900, as shown in FIG. 16, showing an overstroke limit 1800 of about 10 feet (ft), for example, and the range of operation 1810 of about 8 feet (ft), for example, centered about the nominal position 1820.

In various alternative illustrative embodiments, as shown, for example, in FIGS. 20 and 21, heave compensated hydraulic workover systems 2000 and 2100, respectively, may be provided. As shown in FIG. 20, the heave compensated hydraulic workover system 2000 may comprise a hydraulic compensation cylinder system 2010 instead of the hydraulic tensioning cylinder system 210 of the heave compensated hydraulic workover system 900 described above. The hydraulic compensation cylinder system 2010 may be partially above and/or partially below the rig floor 2050. The heave compensated hydraulic workover system 2000 may further comprise a hydraulic jacking system 2020, disposed below the hydraulic compensation cylinder system 2010, and a blow-out pressure system 2070. The hydraulic jacking system 2020 may be connected to the blow-out pressure system 2070 and may also comprise a telescopic guide system 2060 disposed therein.

As shown in FIG. 21, the heave compensated hydraulic workover system 2100 may comprise a hydraulic tensioning cylinder system 2110 that may be similar to the hydraulic tensioning cylinder system 210 of the heave compensated hydraulic workover system 900 described above. The hydraulic tensioning cylinder system 2110 may be disposed above, and connected to, a hydraulic jacking system 2120, which may be similar to the hydraulic jacking system 220 of the heave compensated hydraulic workover system 900 described above. The hydraulic jacking system 2120 may be disposed above, and connected to, a blow-out pressure system 2170. The blow-out pressure system 2170 may be disposed on a base 2175 that is supported by a cable and pulley system 2150 that may be part of a rig's existing riser tensioning system.

In various illustrative embodiments, continuous monitoring and system management may provide control of the large instantaneous loads and riser recoil/up-stroke in the event of an unplanned or emergency disconnect. Further, the heave compensated hydraulic workover system 900 may be designed to operate at a 100% level with two tensioning cylinders 370 isolated, which is normal practice in tensioning system operations.

Referring now to FIG. 3, broadly, various illustrative embodiments may be directed to the hydraulic tensioning cylinder system 210 having a first tensioner end 331, a second tensioner end 332, a retracted position (see FIG. 9, for example), and an extended position (see FIG. 16, for example). The hydraulic tensioning cylinder system 210 may include the following sub-assemblies: at least one mandrel (or spool) 340; at least one flexjoint (or bearing) swivel assembly 350; at least one manifold assembly (or manifold) 360; at least one tensioning cylinder (or cylinder) 370; and at least one base 385. The base 385 facilitates the communication of second tensioner end 332 to additional equipment or conduits, e.g., a riser string and/or a blow-out preventer stack 270. In various illustrative embodiments, the base 385 may include a riser connector member 387, for example. The flexjoint swivel assembly 350 may compensate for vessel offset, i.e., an offset in the vessel and/or rig position in relationship to the well bore center and the riser angle.

The mandrel 340 may include a first mandrel end 341, a second mandrel end 342, a mandrel body 343, a hang-off joint 344, and at least one hang-off donut 345. The mandrel 340 may be connected to a diverter assembly (not shown), through an interface mandrel 346 having a mandrel lower connection flange 347 which may be connected to hang-off joint 344 through any method known to persons of ordinary skill in the art having the benefit of the present disclosure. As shown in FIG. 3, the mandrel lower connection flange 347 may be connected to the hand-off joint 344 through the use of bolts 348.

The hang-off donut 345 may be used to interface with a hydraulic support spider frame (not shown) that is generally supported under the sub-structure of the vessel and/or platform. This may allow the heave compensated hydraulic workover system 900, including the blow-out preventer (B.O.P.) stack 270, as well as the riser, to be disconnected from the wellhead and "hard hung-off" and supported within the spider frame and beams when disconnected from the diverter and/or riser assembly. This arrangement allows the heave compensated hydraulic workover system 900, including the blow-out preventer (B.O.P.) stack 270, as well as the riser, to be disconnected from the diverter and moved horizontally, such as via hydraulic cylinders, under the sub-structure away from the well bore, thereby allowing access to the well bore center and providing clearance for the maintenance of the blow-out preventer (B.O.P.) stack 270 and the installation and running of well interface equipment, particularly production trees and tooling packages. Hang-off donut 345 may be integral to both the flexjoint swivel assembly 350 and the manifold 360. Alternatively, the hang-off donut 345 may be disposed along the tensioning cylinders 370, thereby capturing the tensioning cylinders 370 so that the hang-off donut 345 may be disposed more centrally to the overall length of the hydraulic tensioning cylinder system 210 (see FIG. 8, for example). In this position, the hang-off donut 345 may permit transference of an axial tension load from a cylinder casing 373 of the tensioning cylinder 370 to the mandrel 340 and then directly to the rig structure (not shown).

The second mandrel end 342 is in communication with the flexjoint swivel assembly (or bearing swivel assembly) 350. The flexjoint swivel assembly 350 includes a first (upper) flexjoint end 351, a second (lower) flexjoint end 352, and a housing 353 having at least one swivel member, e.g., bearings, which may be disposed within housing 353. The swivel members of the flexjoint swivel assembly 350 permit rotational movement of the manifold 360, the tensioning cylinders 370, and the base 385 in the direction of arrows 358, 359 and arrows 310, 312. This arrangement allows for mandrel 340 to be locked into a connector (not shown) or the rig floor 891 (see FIG. 8, for example) supported under the diverter housing (not shown) that maintains the flexjoint swivel assembly 350 and/or riser (not shown) in a locked, static position, while allowing the tensioning cylinders 370 and the base 385 to rotate. The flexjoint swivel assembly 350 may provide angular movement of about 15 degrees over about 360 degrees compensating for riser angle and vessel offset. The flexjoint swivel assembly 350 may be any shape or size desired or necessary to permit movement of the manifold assembly 360, the tensioning cylinders 370, and/or the base 385 to a maximum of about 15 degrees angular movement in any direction over about 360 degrees. As shown in FIG. 3, the flexjoint swivel assembly 350 may be cylindrically shaped.

The second (lower) flexjoint end 352 may be in communication with the manifold 360 (discussed in greater detail below) through any method or device known to persons of ordinary skill in the art having the benefit of the present disclosure, e.g., a mechanical connector and/or bolts 348. In various illustrative embodiments, the flexjoint swivel assembly 350 may be integral with the hydraulic tensioning cylinder system 210. The flexjoint swivel assembly 350 permits the manifold 360, and, thus, the mounted tensioning cylinders 370, to move in the direction of the arrows 358, 359 when in tension, thereby minimizing the potential of inducing axial torque and/or imposing bending forces on the mounted tensioning cylinders 370.

While the manifold 360 may be fabricated from a solid piece of material, e.g., stainless steel, in various illustrative embodiments, as shown, for example, in FIG. 5, the manifold 360 may also be fabricated from two separate pieces, or sections, of material, an upper manifold section 560 and a lower manifold section 565. The manifold 360 may also be a welded fabrication of plate or fabricated from one or more castings.

As illustrated in more detail in FIGS. 3 and 4, for example, the manifold 360 may include a top surface 361, a bottom surface 362, a manifold body 363, and bearing landing flange 468. The top surface 361 of the manifold 360 may include at least one control interface 364 (see FIGS. 3 and 5, for example). The control interface 364 may be in communication with at least one of the tensioning cylinders 370 and at least one control source (not shown), e.g., through the use of gooseneck hose assemblies known to persons of ordinary skill in the art having the benefit of the present disclosure. Examples of suitable control sources may include, but are not limited to, atmospheric pressure, accumulators, air pressure vessels (A.P.V.'s), and hoses for connecting the gooseneck hose assembly to the accumulator and air pressure vessel. As shown in FIGS. 3 and 4, for example, the hydraulic tensioning cylinder system 210 may include at least two control interfaces 364 and six tensioning cylinders 370. In various illustrative embodiments, the hydraulic tensioning cylinder system 210 may include the same number of control interfaces 364 and tensioning cylinders 370, with one control interface 364 provided for each of the tensioning cylinders 370.

The control interface 364 permits pressure, e.g., pneumatic and/or hydraulic pressure, to be exerted from the control source, through the control interface 364, through a sub-seal (or seal sub) 369, into the manifold 360, into and through a radial fluid band section, e.g., 365, 366, 367, and into one of the tensioning cylinders 370 to provide tension to the hydraulic tensioning cylinder system 210 as discussed in greater detail below and to move the hydraulic tensioning cylinder system 210 from the retracted position to the extended position and vice versa. It is to be understood that only one control interface 364 may be required, although more than one control source 364 may be employed. Further, it is to be understood that one control interface 364 may be utilized to facilitate communication between all radial bands sections, e.g., 365, 366, 367, and the control source.

In various particular illustrative embodiments, the control interface 364 may not be required to be in communication with the radial fluid band section 366. In various particular illustrative embodiments, the radial fluid band section 366 may be opened to the atmosphere and/or may be blocked by a cover 315.

The manifold 360 may include at least two, and optionally three or more, radial fluid band sections 365, 366, 367, separated into sections by section dividers 400. Each of the radial fluid band sections 365, 366, 367, may interface with respective blind ends 371 and/or transfer tubing 375 of at least one tensioning cylinder 370 via a respective sub-seal 369 that intersects one of the fluid band sections 365, 366, 367, thereby providing isolated and/or partially common conduits to the transfer tubing 375 and/or the blind end 371 of each tensioning cylinder 370. As further shown in FIG. 5, for example, the radial fluid band sections 365, 366, 367 may include two upper radial band sections 365, 367 and one lower radial band section 366. Alternatively, the radial fluid band sections 365, 366, 367 of the manifold 360 may be arranged with two radial fluid band sections, e.g., 365, 367, machined below the other radial fluid band section, e.g., 366. In still other illustrative embodiments, the radial fluid band sections 365, 366, 367 may be machined substantially co-planar to each other.

It is to be understood that one or more of the radial fluid band sections, e.g., 365, 366, 367, may be in communication with either the blind end 371 and/or the transfer tubing 375; provided that at least one radial fluid band section is in communication with each of the blind ends 371 and the transfer tubings 375. For example, as shown in FIG. 5, two of the radial fluid band sections 365, 367 are in communication with the transfer tubing 375 and one of the radial fluid band sections 366 is in communication with the blind end 371.

While each of radial fluid band sections 365, 366, 367 may be in communication with one or more of the control interfaces 364, as shown in FIG. 5, the at least one radial fluid band section in communication with the blind end 371 (one of the radial fluid band sections 366 as shown in FIG. 5), may be filled with inert gas at a slight pressure above atmospheric pressure and/or it may be opened to the atmosphere to provide the required pressure differential into cylinder cavity 578.

Referring now to FIGS. 4 and 7, the creation of the radial fluid band sections 365, 366, 367 may be accomplished by sectioning the manifold 360 into a plurality of sections by machining and/or fabricating the dividers 400, and by machining channels 721 in the manifold body 363 to the dimensions desired and/or established for an appropriate port volume. The machined channels 721 may be profiled with a weld preparation 722 that matches preparation of a filler ring 723 that is welded 724 into the machined channel 721 in the manifold body 363. The manifold 360 may then be face machined, sub-seal 369 counterbores may be machined, and tensioning cylinder mounting bolt holes 499 may be drilled. As shown in FIG. 6, for example, cross-drilled transfer ports 457 may also be drilled. This arrangement provides a neat, clean, low maintenance tensioning cylinder interface that may alleviate the need for multiple hoses and/or manifolding, although, in various illustrative embodiments, each of the tensioning cylinders 370 may require a separate control interface 364. However, providing separate control interfaces 364 for each of the tensioning cylinders 370 may provide for desirable individual and/or independent control of each of the tensioning cylinders 370.

The top surface 361 of the manifold 360 may be machined to accept the flexjoint swivel assembly 350. The manifold ports 457 and/or dividers 400 facilitate the communication of the radial fluid band sections 365, 366, 367 with control instrumentation, e.g., a transducer (not shown).

While the manifold 360 may be fabricated and/or machined in any shape, out of any material, and through any method known to persons of ordinary skill in the art having the benefit of the present disclosure, in various illustrative embodiments, the manifold 360 may be fabricated and/or machined in a sectioned radial configuration, as discussed above, out of stainless steel.

Each of the tensioning cylinders 370, discussed in greater detail below, may be positioned on a radial center that aligns the porting, i.e., the transfer tubing 375 and the blind ends 371, to the appropriate radial fluid band section 365, 366, 367. Sub-seals (or seal subs) 369 may be provided, having resilient gaskets 511, e.g., O-rings, which are preferably redundant, as shown in FIG. 5, for example, to ensure long term reliability of the connection between the control interface 364 and the manifold 360 and between the radial fluid band sections 365, 366, 367 and the transfer tubing 375 and the blind ends 371.

Each of the tensioning cylinders 370 may include the blind end 371, the rod end 372, the cylinder casing 373, the rod 374, the transfer tubing 375 having a transfer tubing cavity 579, a cylinder head 377, and the cylinder cavity 578. While the cylinder casing 373 may be formed out of any material known to persons of ordinary skill in the art having the benefit of the present disclosure, the cylinder casing 373 may be formed out of carbon steel, stainless steel, titanium, or aluminum. Further, the cylinder casing 373 may include a liner (not shown) inside the cylinder casing 373 that contacts the rod 374.

The transfer tubing 375 may also be formed out of any material known to persons of ordinary skill in the art having the benefit of the present disclosure. In various particular illustrative embodiments, the transfer tubing 375 may be formed out of stainless steel with a filament wound composite overlay.

Each of the tensioning cylinders 370 permits vertical movement of the hydraulic tensioning cylinder system 210 from, and to, the retracted position, i.e., each rod 374 is moved into the respective cylinder casing 373 (see FIG. 9, for example). Each of the tensioning cylinders 370 also permits vertical movement of the hydraulic tensioning cylinder system 210 from, and to, the extended position, i.e., each rod 374 is moved from within the respective cylinder casing 373 (see, for example, FIGS. 14-18). It is noted that the hydraulic tensioning cylinder system 210 may include numerous retracted positions and/or extended positions and these terms are used merely to describe the direction of movement. For example, movement from the retracted position to the extended positions means that each rod 374 is being moved from within the respective cylinder casing 373 and movement form the extended position to the retracted position means that each rod 374 is being moved into the respective cylinder casing 373. The use of the term "fully" preceding extended and retracted is to be understood as the point at which the rod 374 can no longer be moved from within the cylinder casing 373 ("fully extended"), and the point at which the rod 374 can no longer be moved into the cylinder casing 373 ("fully retracted").

The hydraulic tensioning cylinder system 210 may be moved from the retracted position to the extended position, and vice versa, using any method or device known to persons skilled in the art having the benefit of the present disclosure. For example, the hydraulic tensioning cylinder system 210 may be moved from the retracted position to the extended position by gravity or by placing a downward force on a tubular using a lifting device. Alternatively, at least one control source in communication with the hydraulic tensioning cylinder system 210 as discussed above may facilitate movement of the hydraulic tensioning cylinder system 210 from the extended position to the retracted position and vice versa.

In various illustrative embodiments, as shown in FIG. 3, for example, each cylinder rod end 372 may include a bearing joint 376 that is not a flexjoint bearing. Each bearing joint 376 may permit rotational movement of each of the tensioning cylinders 370 in the direction of arrows 358, 359 in a similar manner as discussed above with respect to the flexjoint swivel assembly 350. As shown in FIG. 3, each bearing joint 376 may be in communication with the base 385, and each blind end 371 may be in communication with the bottom surface 362 of the manifold 360. The bearing joint 376 may have a range of angular motion of about +/−15 degrees to alleviate some of the potential to induce torque and/or bending forces on the cylinder rod 374.

As shown in FIGS. 3 and 4, the blind ends 371 may be drilled with a bolt pattern to allow bolting in a compact arrangement on the bottom surface 362 of the manifold 360. In various illustrative embodiments, a plurality of appropriately sized tensioning cylinders 370 equally spaced around the manifold 360 may be employed to produce the tension required for the specific application. The tensioning cylinders 370 may be disposed with the rod end 372 down, i.e., the rod end 372 may be closer to the base 385 than to the manifold 360. It is to be understood, however, that one, or all, of the tensioning cylinders 370 may be disposed with the rod end 372 up, i.e., the rod end 372 may be closer to the manifold 360.

Each tensioning cylinder 370 may be designed to interface with at least one control source, e.g., air pressure vessels and accumulators via transfer tubing (or piping) 375 and the manifold 360 and via the blind end 371 and the manifold 360. However, not all of the tensioning cylinders 370 need be in communication with the at least one radial band sections 365, 366, 367.

While it is to be understood that the tensioning cylinder 370 may be formed out of any material known to persons of ordinary skill in the art having the benefit of the present disclosure, the tensioning cylinder 370 may be manufactured from a light weight material that helps to reduce the overall weight of the hydraulic tensioning cylinder system 210, helps to eliminate friction and metal contact within the tensioning cylinder 370, and helps reduce the potential for electrolysis and galvanic action causing corrosion. Examples may include, but are not limited to, carbon steel, stainless steel, aluminum and titanium.

In various illustrative embodiments, as shown in FIG. 22, a method 2200 for running jointed tubulars in a compensated fashion and/or for moving pipe in a pipe light mode may be provided. The method 2200 may comprise providing a device and/or system, as indicated at 2210, the device and/or system, such as the heave compensated hydraulic workover device 200 and/or system 900 described above, comprising a hydraulic tensioning cylinder system 210 comprising at least one mandrel 340, at least one flexjoint swivel assembly 350 in communication with the at least one mandrel 340, at least one manifold 360 in communication with the at least one flexjoint swivel assembly 350, the at least one manifold 360 having a plurality of first radial fluid band sections 366 and second radial fluid band sections 365, 367, a plurality of tensioning cylinders 370 each having an upper blind end 371, a lower rod end 372, and at least one transfer tubing 375, the upper blind end 371 being in communication with a respective one of the plurality of first radial fluid band sections 366, the at least one transfer tubing being in communication with a respective one of the plurality of second radial fluid band sections 365, 367 and the lower rod end 372 being in communication with a bearing joint 376 that is not a flexjoint bearing, and a base 385 in communication with the bearing joint 376, the hydraulic tensioning cylinder system 210 disposed beneath a rig floor 891 and adapted to be connected at the at least one mandrel 340 to the rig floor 891 through a rotary table 800 disposed in the rig floor 891.

The heave compensated hydraulic workover device 200 and/or system 900 may further comprise a hydraulic jacking system 220 comprising a plurality of hydraulic cylinders 230, the hydraulic jacking system 220 having a first portion 240 and a second portion 250, the hydraulic jacking system 220 disposed within the hydraulic tensioning cylinder system 210 beneath the rig floor 891. The heave compensated hydraulic workover device 200 and/or system 900 may also comprise stationary/rotary slips 245 disposed within the hydraulic tensioning cylinder system 210 and connected to one of the first portion 240 and the second portion 250 of the hydraulic jacking system 220, traveling slips 255 disposed within the hydraulic tensioning cylinder system 210 and connected to the one of the first portion 240 and the second portion 250 of the hydraulic jacking system 220 not connected to the stationary/rotary slips 245, and a telescoping guide system 260 disposed within the hydraulic tensioning cylinder system 210 and connected to the traveling slips 255 disposed within the hydraulic tensioning cylinder system 210.

The method 2200 for running jointed tubulars in a compensated fashion and/or for moving pipe in a pipe light mode may further comprise using the heave compensated hydraulic workover device 200 and/or system 900 to do at least one of running jointed tubulars in a compensated fashion and moving pipe in a pipe light mode, as indicated at 2220. The hydraulic jacking system 220 and the hydraulic tensioning system 210 permit the compensation of the hydraulic jacking system 220 along with the tubulars manipulated and controlled by the hydraulic jacking system 220. The method 2200 may further include providing the blow-out pressure equipment 270 (as may be provided with the heave compensated hydraulic workover system 900, for example) so that the blow-out pressure equipment 270 may be contained in the frame system 275 and not experience substantially any tension loads, which may be substantially completely compensated for by the hydraulic tensioning system 210.

The heave compensated hydraulic workover device 200 and/or system 900 and the method 2200 may allow pipe to be moved in a pipe light mode, where the well pressure exerted on an outside diameter of the tubulars creates a force greater than the normal force from the weight of the tubulars. The tubulars may be controlled by the hydraulic jacking system 220 and/or the stationary/rotary slips 245 and/or the traveling slips 255. Motion compensation of the tubulars during the pipe light mode may be accomplished through the hydraulic jacking system 220 and/or the hydraulic tensioning system 210.

Advantageously, the rig floor 891 may be clear of the hydraulic jacking system 220. The hydraulic cylinders 230 and associated rods may extend downward beneath the rig floor 891 rather than upward through and/or above the rig floor 891. In other words, the rig floor 891 may become like the work basket normally associated with conventional hydraulic workover units, such as shown in FIG. 1.

In various illustrative embodiments, the hydraulic tensioning system 210 may advantageously have a high capacity and/or a quick response, be substantially modular and/or substantially completely self-contained, be relatively simple to transport and rig up, have redundant tensioning cylinders 370, which may be individually and/or independently controlled, have a relatively small footprint, and/or be relatively light weight.

In various particular illustrative embodiments, the heave compensated hydraulic workover device 200 may advantageously accommodate about a 10 foot (ft) disconnect, about a 4 foot (ft) heave, and/or about 800,000 pounds (lbs) of force, permit remote operation from the rig floor 891, provide remote cameras and/or a data acquisition system (DAS) that give substantially complete monitoring, substantially reduce and/or substantially eliminate bending moments, provide a fail-to-safe configuration, use proven technology, and use about a 600,000 pound (lb) hydraulic jacking system 220, capable of working with any well pressure and/or with strings of tubulars and/or pipes with diameters in a range of about 0.75 inches (in) to about 9.625 inches (in). In various particular illustrative embodiments, the heave compensated hydraulic workover device 200 may also advantageously fit substantially flush with the rotary table and/or have minimal movement about the rig floor 891, provide that substantially no flanges and/or equipment may be subjected to tensioning and/or bending moments, provide that substantially all equipment may be accommodated below and/or beneath the rig floor 891, provide scalability whereby multi-sized units may use substantially similar designs, and the telescoping guide system 260 may help prevent and/or at least reduce buckling of tubulars in snubbing, and the short tensioning cylinders 370 may accommodate a disconnect, e.g., of about plus or minus 10 feet (ft), for example.

As shown in FIGS. 2, 3, 23, and 24, for example, a heave compensated hydraulic workover device 2300 and/or system 2400 may be provided comprising a hydraulic tensioning cylinder system 210 comprising at least one mandrel 340, at least one flexjoint swivel assembly 350 in communication with the at least one mandrel 340, at least one manifold 360 in communication with the at least one flexjoint swivel assembly 350, the at least one manifold 360 having a plurality of first radial fluid band sections 366 and second radial fluid band sections 365, 367, a plurality of tensioning cylinders 370 each having an upper blind end 371, a lower rod end 372, and at least one transfer tubing 375, the upper blind end 371 being in communication with a respective one of the plurality of first radial fluid band sections 366, the at least one transfer tubing being in communication with a respective one of the plurality of second radial fluid band sections 365, 367 and the lower rod end 372 being in communication with a bearing joint 376 that is not a flexjoint bearing, and a base 385 in communication with the bearing joint 376, the hydraulic tensioning cylinder system 210 disposed beneath a rig floor 891 and adapted to be connected at the at least one mandrel 340 to the rig floor 891 through a rotary table 800 disposed in the rig floor 891. The heave compensated hydraulic workover device 2300 and/or system 2400 may further comprise a well intervention apparatus 2320 disposed at least partially within the hydraulic tensioning cylinder system 210 beneath the rig floor 891, the well intervention apparatus 2320 capable of being used in conjunction with at least one of a well, a wellhead, a blow-out pressure system, a jointed tubular, a pipe, and a drilling string.

The well intervention apparatus 2320 may further comprise at least one of a hydraulic workover device, a hydraulic jacking system 220, a coiled tubing apparatus, a wireline device, a slickline device, and an electric line. In particular, the well intervention apparatus 2320 may further comprise at least one of the hydraulic workover device, the coiled tubing apparatus, the wireline device, the slickline device, and the electric line, and the hydraulic jacking system 220 comprising a plurality of hydraulic cylinders 230, the hydraulic jacking system 220 having a first portion 240 and a second portion 250, the hydraulic jacking system 220 disposed within the hydraulic tensioning cylinder system 210 beneath the rig floor 891. The heave compensated hydraulic workover device 2300 and/or system 2400 may also comprise stationary/rotary slips 245 disposed within the hydraulic tensioning cylinder system 210 and connected to one of the first portion 240 and the second portion 250 of the hydraulic jacking system 220, traveling slips 255 disposed within the hydraulic tensioning cylinder system 210 and connected to the one of the first portion 240 and the second portion 250 of the hydraulic jacking system 220 not connected to the stationary/rotary slips 245, and a telescoping guide system 260 disposed within the hydraulic tensioning cylinder system 210 and connected to the traveling slips 255 disposed within the hydraulic tensioning cylinder system 210. The heave compensated hydraulic workover system 2400 may also comprise a blow-out pressure system 2470 optionally disposed at least partially internal to the hydraulic tensioning cylinder system 210.

As shown in FIGS. 2, 3, 25, 26 and 31, for example, a heave compensated hydraulic workover device 2500 and/or system 2600 may be provided comprising a hydraulic tensioning cylinder system 2510 comprising at least one mandrel 340, at least one flexjoint swivel assembly 350 in communication with the at least one mandrel 340, at least one manifold 2560 in communication with the at least one flexjoint swivel assembly 350, the at least one manifold 2560 having a first radial fluid band 2566 and second radial fluid bands 2565, 2567, also shown in FIG. 27, a plurality of tensioning cylinders 370 each having an upper blind end 371, a lower rod end 372, and at least one transfer tubing 375, the upper blind end 371 being in communication with the first radial fluid band 2566, the at least one transfer tubing being in communication with a respective one of the second radial fluid bands 2565, 2567 and the lower rod end 372 being in communication with a bearing joint 2576 that is a flexjoint bearing, and a base 385 in communication with the bearing joint 2576, the hydraulic tensioning cylinder system 2510 disposed beneath a rig floor 891, as shown in FIG. 31, for example, and adapted to be connected at the at least one mandrel 340 to the rig floor 891 through a rotary table 800 disposed in the rig floor 891. The heave compensated hydraulic workover device 2500 and/or system 2600 may further comprise a well intervention apparatus 2520 disposed at least partially within the hydraulic tensioning cylinder system 2510 beneath the rig floor 891, the well intervention apparatus 2520 capable of being used in conjunction with at least one of a well, a wellhead, a blow-out pressure system, a jointed tubular, a pipe, and a drilling string.

The well intervention apparatus 2520 may further comprise at least one of a hydraulic workover device, a hydraulic jacking system 220, a coiled tubing apparatus, a wireline device, a slickline device, and an electric line. In particular, the well intervention apparatus 2520 may further comprise at least one of the hydraulic workover device, the coiled tubing apparatus, the wireline device, the slickline device, and the electric line, and the hydraulic jacking system 220 comprising a plurality of hydraulic cylinders 230, the hydraulic jacking system 220 having a first portion 240 and a second portion 250, the hydraulic jacking system 220 disposed within the hydraulic tensioning cylinder system 2510 beneath the rig floor 891. The heave compensated hydraulic workover device 2500 and/or system 2600 may also comprise stationary/rotary slips 245 disposed within the hydraulic tensioning cylinder system 2510 and connected to one of the first portion 240 and the second portion 250 of the hydraulic jacking system 220, traveling slips 255 disposed within the hydraulic tensioning cylinder system 2510 and connected to the one of the first portion 240 and the second portion 250 of the hydraulic jacking system 220 not connected to the stationary/rotary slips 245, and a telescoping guide system 260 disposed within the hydraulic tensioning cylinder system 2510 and connected to the traveling slips 255 disposed within the hydraulic tensioning cylinder system 2510. The heave compensated hydraulic workover system 2600 may also comprise a blow-out pressure system 2670 optionally disposed at least partially internal to the hydraulic tensioning cylinder system 2510.

Referring now to FIGS. 3 and 25, broadly, various alternative illustrative embodiments may be directed to the hydraulic tensioning cylinder system 2510 (similar to the hydraulic tensioning cylinder system as described in U.S. Pat. Nos. 6,530,430 and 6,554,072, for example) having a first tensioner end 331, a second tensioner end 332, a retracted position (see FIG. 9, for example), and an extended position (see FIG. 16, for example). The hydraulic tensioning cylinder system 2510 may include the following subassemblies: at least one mandrel (or spool) 340; at least one flexjoint (or bearing) swivel assembly 350; at least one manifold assembly (or manifold) 2560; at least one tensioning cylinder (or cylinder) 370; and at least one base 385. The base 385 facilitates the communication of second tensioner end 332 to additional equipment or conduits, e.g., a riser string and/or a blow-out preventer stack 2670. In various illustrative embodiments, the base 385 may include a riser connector member 387, for example. The flexjoint swivel assembly 350 may compensate for vessel offset, i.e., an offset in the vessel and/or rig position in relationship to the well bore center and the riser angle.

The mandrel 340 may include a first mandrel end 341, a second mandrel end 342, a mandrel body 343, a hang-off joint 344, and at least one hang-off donut 345. The mandrel 340 may be connected to a diverter assembly (not shown), through an interface mandrel 346 having a mandrel lower connection flange 347 which may be connected to hang-off joint 344 through any method known to persons of ordinary skill in the art having the benefit of the present disclosure. As shown in FIG. 25, the mandrel lower connection flange 347 may be connected to the hand-off joint 344 through the use of bolts 348.

The hang-off donut 345 may be used to interface with a hydraulic support spider frame (not shown) that is generally supported under the sub-structure of the vessel and/or platform. This may allow the heave compensated hydraulic workover system 2600, including the blow-out preventer (B.O.P.) stack 2670, as well as the riser, to be disconnected from the wellhead and "hard hung-off" and supported within the spider frame and beams when disconnected from the diverter and/or riser assembly. This arrangement allows the heave compensated hydraulic workover system 2600, including the blow-out preventer (B.O.P.) stack 2670, as well as the riser, to be disconnected from the diverter and moved horizontally, such as via hydraulic cylinders, under the sub-structure away from the well bore, thereby allowing access to the well bore center and providing clearance for the maintenance of the blow-out preventer (B.O.P.) stack 2670 and the installation and running of well interface equipment, particularly production trees and tooling packages. Hang-off donut 345 may be integral to both the flexjoint swivel assembly 350 and the manifold 2560. Alternatively, the hang-off donut 345 may be disposed along the tensioning cylinders 370, thereby capturing the tensioning cylinders 370 so that the hang-off donut 345 may be disposed more centrally to the overall length of the hydraulic tensioning cylinder system 2510 (see FIG. 8, for example). In this position, the hang-off donut 345 may permit transference of an axial tension load from a cylinder casing 373 of the tensioning cylinder 370 to the mandrel 340 and then directly to the rig structure (not shown).

The second mandrel end 342 is in communication with the flexjoint swivel assembly (or bearing swivel assembly) 350. The flexjoint swivel assembly 350 includes a first (upper) flexjoint end 351, a second (lower) flexjoint end 352, and a housing 353 having at least one swivel member, e.g., bearings, which may be disposed within housing 353. The swivel members of the flexjoint swivel assembly 350 permit rotational movement of the manifold 2560, the tensioning cylinders 370, and the base 385 in the direction of arrows 358, 359 and arrows 310, 312. This arrangement allows for mandrel 340 to be locked into a connector (not shown) or the rig floor 891 (see FIG. 8, for example) supported under the diverter housing (not shown) that maintains the flexjoint swivel assembly 350 and/or riser (not shown) in a locked, static position, while allowing the tensioning cylinders 370 and the base 385 to rotate. The flexjoint swivel assembly 350 may provide angular movement of about 15 degrees over about 360 degrees compensating for riser angle and vessel offset. The flexjoint swivel assembly 350 may be any shape or size desired or necessary to permit movement of the manifold assembly 2560, the tensioning cylinders 370, and/or the base 385 to a maximum of about 15 degrees angular movement in any direction over about 360 degrees. As shown in FIG. 25, the flexjoint swivel assembly 350 may be cylindrically shaped.

The second (lower) flexjoint end 352 may be in communication with the manifold 2560 (discussed in greater detail below) through any method or device known to persons of ordinary skill in the art having the benefit of the present disclosure, e.g., a mechanical connector and/or bolts 348. In various illustrative embodiments, the flexjoint swivel assembly 350 may be integral with the hydraulic tensioning cylinder system 2510. The flexjoint swivel assembly 350 permits the manifold 2560, and, thus, the mounted tensioning cylinders 370, to move in the direction of the arrows 358, 359 when in tension, thereby minimizing the potential of inducing axial torque and/or imposing bending forces on the mounted tensioning cylinders 370.

While the manifold 2560 may be fabricated from a solid piece of material, e.g., stainless steel, in various illustrative embodiments, as shown, for example, in FIG. 27, the manifold 2560 may also be fabricated from two separate pieces, or sections, of material, an upper manifold section 2860 and a lower manifold section 2865. The manifold 2560 may also be a welded fabrication of plate or fabricated from one or more castings.

As illustrated in more detail in FIGS. 25-29, for example, the manifold 2560 may include a top surface 361, a bottom surface 362, a manifold body 363, and bearing landing flange 468. The top surface 361 of the manifold 2560 may include at least one control interface 364 (see FIGS. 25, 26, and 28, for example). The control interface 364 may be in communication with at least one of the tensioning cylinders 370 and at least one control source (not shown), e.g., through the use of gooseneck hose assemblies known to persons of ordinary skill in the art having the benefit of the present disclosure. Examples of suitable control sources may include, but are not limited to, atmospheric pressure, accumulators, air pressure vessels (A.P.V.'s), and hoses for connecting the gooseneck hose assembly to the accumulator and air pressure vessel. As shown in FIGS. 25-27, for example, the hydraulic tensioning cylinder system 2510 may include at least two control interfaces 364 and six tensioning cylinders 370. In various illustrative embodiments, the hydraulic tensioning cylinder system 2510 may include the same number of control interfaces 364 and tensioning cylinders 370, with one control interface 364 provided for each of the tensioning cylinders 370.

The control interface 364 permits pressure, e.g., pneumatic and/or hydraulic pressure, to be exerted from the control source, through the control interface 364, through a sub-seal (or seal sub) 369, into the manifold 2560, into and through a radial fluid band, e.g., 2565, 2566, 2567, and into one of the tensioning cylinders 370 to provide tension to the hydraulic tensioning cylinder system 2510 as discussed in greater detail below and to move the hydraulic tensioning cylinder system 2510 from the retracted position to the extended position and vice versa. It is to be understood that only one control interface 364 may be required, although more than one control source 364 may be employed. Further, it is to be understood that one control interface 364 may be utilized to facilitate communication between all radial bands, e.g., 2565, 2566, 2567, and the control source.

In various particular illustrative embodiments, the control interface 364 may not be required to be in communication with the radial fluid band 2566. In various particular illustrative embodiments, the radial fluid band 2566 may be opened to the atmosphere and/or may be blocked by a cover 315.

The manifold 2560 may include at least two, and optionally three or more, radial fluid bands 2565, 2566, 2567, which interface with the blind end 371 and the transfer tubing 375 of at least one tensioning cylinder 370 via sub-seals 369 that intersect the fluid bands 2565, 2566, 2567, thereby providing isolated common conduits to the transfer tubing 375 and the blind end 371 of each tensioning cylinder 370. As further shown in FIG. 28, for example, the radial fluid bands 2565, 2566, 2567 may include two upper radial bands 2565, 2567 and one lower radial band 2566. Alternatively, the radial fluid bands 2565, 2566, 2567 of the manifold 2560 may be arranged with two radial fluid bands, e.g., 2565, 2567, machined below the other radial fluid band, e.g., 2566. In still other illustrative embodiments, the radial fluid bands 2565, 2566, 2567 may be machined substantially co-planar to each other.

It is to be understood that one or more of the radial fluid band, e.g., 2565, 2566, 2567, may be in communication with either the blind end 371 or the transfer tubing 375; provided that at least one radial fluid band is in communication with each of the blind ends 371 and the transfer tubings 375. For example, as shown in FIG. 28, two of the radial fluid bands 2565, 2567 are in communication with the transfer tubing 375 and one of the radial fluid bands 2566 is in communication with the blind end 371.

While each of radial fluid bands 2565, 2566, 2567 may be in communication with one or more of the control interfaces 364, as shown in FIG. 28, the at least one radial fluid band in communication with the blind end 371 (the radial fluid band 2566 as shown in FIG. 28), may be filled with inert gas at a slight pressure above atmospheric pressure or it may be opened to the atmosphere to provide the required pressure differential into the cylinder cavity 578.

Referring now to FIGS. 28 and 30, the creation of the radial fluid bands 2565, 2566, 2567 may be accomplished by machining channels 721 in the manifold body 363 to the dimensions desired and/or established for an appropriate port volume. The machined channels 721 may be profiled with a weld preparation 722 that matches preparation of a filler ring 723 that is welded 724 into the machined channel 721 in the manifold body 363. The manifold 2560 may then be face machined, sub-seal 369 counterbores may be machined, and tensioning cylinder mounting bolt holes 499 (see FIG. 27, for example) may be drilled. As shown in FIG. 29, for example, cross-drilled transfer ports 457 may also be drilled. This arrangement provides a neat, clean, low maintenance tensioning cylinder interface alleviating the need for multiple hoses and manifolding, i.e., each of the tensioning cylinders 370 does not require a separate control interface 364.

The top surface 361 of the manifold 2560 may be machined to accept the flexjoint swivel assembly 350. The manifold ports 457 facilitate the communication of the radial fluid bands 2565, 2566, 2567 with control instrumentation, e.g., a transducer (not shown).

While the manifold 2560 may be fabricated and/or machined in any shape, out of any material, and through any method known to persons of ordinary skill in the art having the benefit of the present disclosure, in various illustrative embodiments, the manifold 2560 may be fabricated and machined in a radial configuration, as discussed above, out of stainless steel.

Each of the tensioning cylinders 370, discussed in greater detail below, may be positioned on a radial center that aligns the porting, i.e., the transfer tubing 375 and the blind ends 371, to the appropriate radial fluid band 2565, 2566, 2567. Sub-seals (or seal subs) 369 may be provided, having resilient gaskets 511, e.g., O-rings, which are preferably redundant, as shown in FIG. 28, for example, to ensure long term reliability of the connection between the control interface 364 and the manifold 2560 and between the radial fluid bands 2565, 2566, 2567 and the transfer tubing 375 and the blind ends 371.

Each of the tensioning cylinders 370 may include the blind end 371, the rod end 372, the cylinder casing 373, the rod 374, the transfer tubing 375 having the transfer tubing cavity 579, the cylinder head 377, and the cylinder cavity 578. While the cylinder casing 373 may be formed out of any material known to persons of ordinary skill in the art having the benefit of the present disclosure, the cylinder casing 373 may be formed out of carbon steel, stainless steel, titanium, or aluminum. Further, the cylinder casing 373 may include a liner (not shown) inside the cylinder casing 373 that contacts the rod 374.

The transfer tubing 375 may also be formed out of any material known to persons of ordinary skill in the art having the benefit of the present disclosure. In various particular illustrative embodiments, the transfer tubing 375 may be formed out of stainless steel with a filament wound composite overlay.

Each of the tensioning cylinders 370 permits vertical movement of the hydraulic tensioning cylinder system 2510 from, and to, the retracted position, i.e., each rod 374 is moved into the respective cylinder casing 373 (see FIG. 9, for example). Each of the tensioning cylinders 370 also permits vertical movement of the hydraulic tensioning cylinder system 2510 from, and to, the extended position, i.e., each rod 374 is moved from within the respective cylinder casing 373 (see, for example, FIGS. 14-18). It is noted that the hydraulic tensioning cylinder system 2510 may include numerous retracted positions and/or extended positions and these terms are used merely to describe the direction of movement. For example, movement from the retracted position to the extended positions means that each rod 374 is being moved from within the respective cylinder casing 373 and movement form the extended position to the retracted position means that each rod 374 is being moved into the respective cylinder casing 373. The use of the term "fully" preceding extended and retracted is to be understood as the point at which the rod 374 can no longer be moved from within the cylinder casing 373 ("fully extended"), and the point at which the rod 374 can no longer be moved into the cylinder casing 373 ("fully retracted").

The hydraulic tensioning cylinder system 2510 may be moved from the retracted position to the extended position, and vice versa, using any method or device known to persons skilled in the art having the benefit of the present disclosure. For example, the hydraulic tensioning cylinder system 2510 may be moved from the retracted position to the extended position by gravity or by placing a downward force on a tubular using a lifting device. Alternatively, at least one control source in communication with the hydraulic tensioning cylinder system 2510 as discussed above may facilitate movement of the hydraulic tensioning cylinder system 2510 from the extended position to the retracted position and vice versa.

In various illustrative embodiments, as shown in FIGS. 25 and 26 for example, each cylinder rod end 372 may include at least one flexjoint bearing 2576. Each flexjoint bearing 2576 permits rotational movement of each of the tensioning cylinders 370 in the direction of arrows 358, 359, 310, and 312 in the same manner as discussed above with respect to the flexjoint swivel assembly 350. As shown in FIGS. 25 and 26, each flexjoint bearing 2576 is in communication with the base 385, and each blind end 371 is in communication with the bottom surface 362 of the manifold 2560. In various alternative illustrative embodiments, each flexjoint bearing 2576 may be in communication with a lower flexjoint swivel assembly 2580. The flexjoint bearing 2576 may have a range of angular motion of about +/−15 degrees to alleviate some of the potential to induce torque and/or bending forces on the cylinder rod 374.

As shown in FIGS. 25-27, the blind ends 371 may be drilled with a bolt pattern to allow bolting in a compact arrangement on the bottom surface 362 of the manifold 2560. In various illustrative embodiments, a plurality of appropriately sized tensioning cylinders 370 equally spaced around the manifold 2560 may be employed to produce the tension required for the specific application. The tensioning cylinders 370 may be disposed with the rod end 372 down, i.e., the rod end 372 may be closer to the base 385 than to the manifold 2560. It is to be understood, however, that one, or all, of the tensioning cylinders 370 may be disposed with the rod end 372 up, i.e., the rod end 372 may be closer to the manifold 2560.

Each tensioning cylinder 370 may be designed to interface with at least one control source, e.g., air pressure vessels and accumulators via transfer tubing (or piping) 375 and the manifold 2560 and via the blind end 371 and the manifold 2560. However, not all of the tensioning cylinders 370 need be in communication with the at least one radial band 2565, 2566, 2567.

While it is to be understood that the tensioning cylinder 370 may be formed out of any material known to persons of ordinary skill in the art having the benefit of the present disclosure, the tensioning cylinder 370 may be manufactured from a light weight material that helps to reduce the overall weight of the hydraulic tensioning cylinder system 2510, helps to eliminate friction and metal contact within the tensioning cylinder 370, and helps reduce the potential for electrolysis and galvanic action causing corrosion. Examples may include, but are not limited to, carbon steel, stainless steel, aluminum and titanium.

In various illustrative embodiments, the lower flexjoint swivel assembly 2580 is in communication with the base 385. The lower flexjoint swivel assembly 2580 consists of an inner mandrel 2583 and an outer radial member or housing 2582 that contains at least one swivel member (not shown), e.g., bearings. The inner mandrel 2583 may include a flange 2584 that is in communication with a riser, indicated schematically by 2670 in FIG. 26, for example.

Swivel members of lower flexjoint swivel assembly 2580 permit movement of the upper flexjoint swivel assembly 350, the manifold 2560, the tensioning cylinder 370, and the lower flexjoint swivel assembly 2580 in the direction of the arrows 358, 359 and the arrows 310, 312. As with the upper flexjoint swivel assembly 350, the lower flexjoint swivel assembly 2580 is employed to further alleviate the potential for induced axial torque while tensioner 2510 is in tension. Preferably, the lower flexjoint swivel assembly 2580 has a range of angular motion of +/−15 degrees for alleviating the potential to induce torque and/or bending forces on tensioner 2510.

The lower flexjoint swivel assembly 2580 may be any shape or size desired or necessary to permit radial movement of the upper flexjoint swivel assembly 350, the manifold assembly 2560, the tensioning cylinder 370, and the lower flexjoint swivel assembly 2580 in the direction of the arrows 358, 359. As shown in FIG. 25, the lower flexjoint swivel assembly 2580 is preferably cylindrically shaped.

The base 385 facilitates connecting the second end 332 of the tensioner 2510 to other subsea appliances or equipment, e.g., blowout preventer stacks 270, production trees, and manifolds, and riser components, e.g., tubulars. In various illustrative embodiments, the base 385 is equipped with the riser connector member 387 that is common to the flange/connectors employed on the riser string to facilitate connection of the tensioner 2510 to a riser or other components, indicated schematically by 2670 in FIG. 26, for example. Examples of riser connecter member 87 known in the art include latch dog profile as discussed in greater detail below regarding mandrel 40, locking rings, load rings, and casing slips.

The base 385 also includes the plurality of flexjoint bearings 2576 for connecting the tensioning cylinder 370 to the base 385. The flexjoint bearings 2576 alleviate the potential for the tensioning cylinder 370 and the rod 374 bending movement that would cause increased wear in the packing elements (not shown) in the gland seal (not shown) disposed at the interface between the rod 374 and the cylinder casing 373. Each flexjoint bearing 2576 provides an angular motion of range of 15 degrees over 360 degrees in the direction of the arrows 358, 359 and the arrows 310, 312.

In drilling applications, the tensioner 210, 2510 may be connected to the diverter (not shown), which is generally supported under the drilling rig floor sub-structure through any method or manner known by persons skilled in the art. In various illustrative embodiments, the connection between the tensioner 210, 2510 and the diverter may be accomplished by means of a bolted flange (not shown), e.g., via a studded connection. In various other illustrative embodiments, the tensioner 210, 2510 may be connected to the diverter by inserting the mandrel interface 347 into a connector (not shown) attached to the diverter. In such illustrative embodiments, the interface mandrel 346 may include a latch dog profile 349 that connects to the connector via matching latch dogs that may be hydraulically, pneumatically, or manually energized. In addition, a metal-to-metal sealing gasket profile may be machined in the top of the mandrel 340 to effect a pressure-containing seal within the connector.

A production riser or a drilling riser, collectively "riser," can be run to depth with the tensioner 210, 2510 using a lifting device, e.g., a crane, jack knife hoisting rig, rack and pinion elevator assembly, or other suitable lifting device. Therefore, in various illustrative embodiments, the production riser for drill step tests and other uses, or, in various other illustrative embodiments, the drilling riser, can be assembled without the need for large amounts of heavy equipment, e.g., a full-size derrick.

In various illustrative embodiments, as shown in FIG. 32, a method 3200 for intervening with and operating on at least one of a well, a wellhead, a blow-out pressure system, a jointed tubular, a pipe, and a drilling string, indicated schematically by 2470 in FIG. 24, may be provided. The method 3200 may comprise providing a device and/or system, as indicated at 3210, the device and/or system, such as the heave compensated hydraulic workover device 2300 and/or system 2400 described above, comprising a hydraulic tensioning cylinder system 210 comprising at least one mandrel 340, at least one flexjoint swivel assembly 350 in communication with the at least one mandrel 340, at least one manifold 360 in communication with the at least one flexjoint swivel assembly 350, the at least one manifold 360 having a plurality of first radial fluid band sections 366 and second radial fluid band sections 365, 367, a plurality of tensioning cylinders 370 each having an upper blind end 371, a lower rod end 372, and at least one transfer tubing 375, the upper blind end 371 being in communication with a respective one of the plurality of first radial fluid band sections 366, the at least one transfer tubing being in communication with a respective one of the plurality of second radial fluid band sections 365, 367 and the lower rod end 372 being in communication with a bearing joint 376 that is not a flexjoint bearing, and a base 385 in communication with the bearing joint 376, the hydraulic tensioning cylinder system 210 disposed beneath a rig floor 891 and adapted to be connected at the at least one mandrel 340 to the rig floor 891 through a rotary table 800 disposed in the rig floor 891.

The heave compensated hydraulic workover device 2300 and/or system 2400 may further comprise a well intervention apparatus 2320 disposed at least partially within the hydraulic tensioning cylinder system 210 beneath the rig floor 891, the well intervention apparatus 2320 capable of being used in conjunction with at least one of the well, the wellhead, the blow-out pressure system, the jointed tubular, the pipe, and the drilling string 2470. The heave compensated hydraulic workover system 2400 may further comprise a blow-out pressure system 270 disposed in a frame system 275 beneath the well intervention apparatus 2320 and at least partially internal to the hydraulic tensioning cylinder system 210. The method 3200 for intervening with and operating on at least one of the well, the wellhead, the blow-out pressure system, the jointed tubular, the pipe, and the drilling string 2470 may further comprise using the heave compensated hydraulic workover device 2300 and/or system 2400 to intervene with and operate on the at least one of the well, the wellhead, the blow-out pressure system, the jointed tubular, the pipe, and the drilling string 2470, as indicated at 3220.

In various illustrative embodiments, as shown in FIG. 33, a method 3300 for running jointed tubulars in a compensated fashion and/or for moving pipe in a pipe light mode may be provided. The method 3300 may comprise providing a device and/or system, as indicated at 3310, the device and/or system, such as the heave compensated hydraulic workover device 2500 and/or system 2600 described above, comprising a hydraulic tensioning cylinder system 2510 comprising at least one mandrel 340, at least one flexjoint swivel assembly 350 in communication with the at least one mandrel 340, at least one manifold 2560 in communication with the at least one flexjoint swivel assembly 350, the at least one manifold 2560 having a first radial fluid band 2566 and a second radial fluid band 365 and/or 367, a plurality of tensioning cylinders 370 each having an upper blind end 371, a lower rod end 372, and at least one transfer tubing 375, the upper blind end 371 being in communication with the first radial fluid band 366, the at least one transfer tubing being in communication with the second radial fluid band 365 and/or 367, and the lower rod end 372 being in communication with a bearing joint 2576 that is a flexjoint bearing, and a base 385 in communication with the bearing joint 2576, the hydraulic tensioning cylinder system 2510 disposed beneath a rig floor 891 and adapted to be connected at the at least one mandrel 340 to the rig floor 891 through a rotary table 800 disposed in the rig floor 891.

The heave compensated hydraulic workover device 2500 and/or system 2600 may further comprise a hydraulic jacking system 220 comprising a plurality of hydraulic cylinders 230, the hydraulic jacking system 220 having a first portion 240 and a second portion 250, the hydraulic jacking system 220 disposed within the hydraulic tensioning cylinder system 2510 beneath the rig floor 891. The heave compensated hydraulic workover device 2500 and/or system 2600 may also comprise stationary/rotary slips 245 disposed within the hydraulic tensioning cylinder system 2510 and connected to one of the first portion 240 and the second portion 250 of the hydraulic jacking system 220, traveling slips 255 disposed within the hydraulic tensioning cylinder system 2510 and connected to the one of the first portion 240 and the second portion 250 of the hydraulic jacking system 220 not connected to the stationary/rotary slips 245, and a telescoping guide system 260 disposed within the hydraulic tensioning cylinder system 2510 and connected to the traveling slips 255 disposed within the hydraulic tensioning cylinder system 2510.

The method 3300 for running jointed tubulars in a compensated fashion and/or for moving pipe in a pipe light mode may further comprise using the heave compensated hydraulic workover device 2500 and/or system 2600 to do at least one of running jointed tubulars in a compensated fashion and moving pipe in a pipe light mode, as indicated at 3320. The hydraulic jacking system 220 and the hydraulic tensioning system 2510 permit the compensation of the hydraulic jacking system 220 along with the tubulars manipulated and controlled by the hydraulic jacking system 220. The method 3300 may further include providing the blow-out pressure equipment 270 (as may be provided with the heave compensated hydraulic workover system 2600, for example) so that the blow-out pressure equipment 270 may be contained in the frame system 275 and not experience substantially any tension loads, which may be substantially completely compensated for by the hydraulic tensioning system 2510.

The heave compensated hydraulic workover device 2500 and/or system 2600 and the method 3300 may allow pipe to be moved in a pipe light mode, where the well pressure exerted on an outside diameter of the tubulars creates a force greater than the normal force from the weight of the tubulars. The tubulars may be controlled by the hydraulic jacking system 220 and/or the stationary/rotary slips 245 and/or the traveling slips 255. Motion compensation of the tubulars during the pipe light mode may be accomplished through the hydraulic jacking system 220 and/or the hydraulic tensioning system 2510.

In various illustrative embodiments, as shown in FIG. 34, a method 3400 for intervening with and operating on at least one of a well, a wellhead, a blow-out pressure system, a jointed tubular, a pipe, and a drilling string, indicated schematically by 2670 in FIG. 26, may be provided. The method 3400 may comprise providing a device and/or system, as indicated at 3410, the device and/or system, such as the heave compensated hydraulic workover device 2500 and/or system 2600 described above, comprising a hydraulic tensioning cylinder system 2510 comprising at least one mandrel 340, at least one flexjoint swivel assembly 350 in communication with the at least one mandrel 340, at least one manifold 2560 in communication with the at least one flexjoint swivel assembly 350, the at least one manifold 2560 having a first radial fluid band 2566 and a second radial fluid band 365 and/or 367, a plurality of tensioning cylinders 370 each having an upper blind end 371, a lower rod end 372, and at least one transfer tubing 375, the upper blind end 371 being in communication with the first radial fluid band 366, the at least one transfer tubing being in communication with the second radial fluid band 365 and/or 367, and the lower rod end 372 being in communication with a bearing joint 2576 that is a flexjoint bearing, and a base 385 in communication with the bearing joint 2576, the hydraulic tensioning cylinder system 2510 disposed beneath a rig floor 891 and adapted to be connected at the at least one mandrel 340 to the rig floor 891 through a rotary table 800 disposed in the rig floor 891.

The heave compensated hydraulic workover device 2500 and/or system 2600 may further comprise a well intervention apparatus 2520 disposed at least partially within the hydraulic tensioning cylinder system 210 beneath the rig floor 891, the well intervention apparatus 2520 capable of being used in conjunction with at least one of the well, the wellhead, the blow-out pressure system, the jointed tubular, the pipe, and the drilling string 2670. The heave compensated hydraulic workover system 2600 may further comprise a blow-out pressure system 270 disposed in a frame system 275 beneath the well intervention apparatus 2520 and at least partially internal to the hydraulic tensioning cylinder system 2510. The method 3400 for intervening with and operating on at least one of the well, the wellhead, the blow-out pressure system, the jointed tubular, the pipe, and the drilling string 2670 may further comprise using the heave compensated hydraulic workover device 2500 and/or system 2600 to intervene with and operate on the at least one of the well, the wellhead, the blow-out pressure system, the jointed tubular, the pipe, and the drilling string 2670, as indicated at 3420.

The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. In particular, every range of values (of the form, "from about a to about b," or, equivalently, "from approximately a to b," or, equivalently, "from approximately a-b") disclosed herein is to be understood as referring to the power set (the set of all subsets) of the respective range of values, in the sense of Georg Cantor. Accordingly, the protection sought herein is as set forth in the claims below.

Therefore, the present invention is well adapted to attain the ends and advantages mentioned as well as those that are inherent therein. While numerous changes may be made by those skilled in the art, such changes are encompassed within the spirit of this present invention as defined by the appended claims.

What is claimed is:

1. A device comprising:

a hydraulic tensioning cylinder system comprising at least one mandrel, at least one flexjoint swivel assembly in communication with the at least one mandrel, at least one manifold in communication with the at least one flexjoint swivel assembly, the at least one manifold having a first radial fluid band and a second radial fluid band, a plurality of tensioning cylinders each having an upper blind end, a lower rod end, and at least one transfer tubing, the upper blind end being in communication with the first radial fluid band, the at least one transfer tubing being in communication with the second radial fluid band and the lower rod end being in communication with a bearing joint that is a flexjoint bearing, and a base in communication with the bearing joint, the hydraulic tensioning cylinder system disposed beneath a rig floor and adapted to be connected at the at least one mandrel to the rig floor through a rotary table disposed in the rig floor;

a hydraulic jacking system comprising a plurality of hydraulic cylinders, the hydraulic jacking system having a first portion and a second portion, the hydraulic jacking system disposed within the hydraulic tensioning cylinder system beneath the rig floor;

stationary/rotary slips disposed within the hydraulic tensioning cylinder system and connected to one of the first portion and the second portion of the hydraulic jacking system;

traveling slips disposed within the hydraulic tensioning cylinder system and connected to the one of the first portion and the second portion of the hydraulic jacking system not connected to the stationary/rotary slips; and a telescoping guide system disposed within the hydraulic tensioning cylinder system and connected to the traveling slips disposed within the hydraulic tensioning cylinder system.

2. The device of claim 1, wherein the hydraulic tensioning cylinder system is capable of at least one of lifting with and sustaining forces in a range of about 200,000 pounds (lbs) to about 1,500,000 pounds (lbs).

3. The device of claim 1, wherein at least one of the plurality of hydraulic cylinders has a spline torque tube disposed therein to provide a torque path to a rotary table disposed in the rig floor.

4. The device of claim 1, wherein the hydraulic jacking system is capable of lifting with forces in a range of about 120,000 pounds (lbs) to about 600,000 pounds (lbs) and at least one of snubbing and pushing with forces in a range of about 60,000 pounds (lbs) to about 300,000 pounds (lbs).

5. The device of claim 1, further comprising:

a blow-out pressure system disposed in a frame system beneath the second portion of the hydraulic jacking system and at least partially internal to the hydraulic tensioning cylinder system.

6. A method for running jointed tubulars in a compensated fashion and for moving pipe in a pipe light mode, the method comprising:

providing a heave compensated hydraulic workover device comprising:

a hydraulic tensioning cylinder system comprising at least one mandrel, at least one flexjoint swivel assembly in communication with the at least one mandrel, at least one manifold in communication with the at least one flexjoint swivel assembly, the at least one manifold having a first radial fluid band and a second radial fluid band, a plurality of tensioning cylinders each having an upper blind end, a lower rod end, and at least one transfer tubing, the upper blind end being in communication with the first radial fluid band, the at least one transfer tubing being in communication with the second radial fluid band and the lower rod end being in communication with a bearing joint that is a flexjoint bearing, and a base in communication with the bearing joint, the hydraulic tensioning cylinder system disposed beneath a rig floor and adapted to be connected at the at least one mandrel to the rig floor through a rotary table disposed in the rig floor;

a hydraulic jacking system comprising a plurality of hydraulic cylinders, the hydraulic jacking system having a first portion and a second portion, the hydraulic jacking system disposed within the hydraulic tensioning cylinder system beneath the rig floor;

stationary/rotary slips disposed within the hydraulic tensioning cylinder system and connected to one of the first portion and the second portion of the hydraulic jacking system;

traveling slips disposed within the hydraulic tensioning cylinder system and connected to the one of the first portion and the second portion of the hydraulic jacking system not connected to the stationary/rotary slips; and a telescoping guide system disposed within the hydraulic tensioning cylinder system and connected to the traveling slips disposed within the hydraulic tensioning cylinder system; and using the heave compensated hydraulic workover device to do at least one of running jointed tubulars in a compensated fashion and moving pipe in a pipe light mode.

7. The method of claim 6, wherein the hydraulic tensioning cylinder system is capable of at least one of lifting with and sustaining forces in a range of about 200,000 pounds (lbs) to about 1,500,000 pounds (lbs).

8. The method of claim 6, wherein at least one of the plurality of hydraulic cylinders has a spline torque tube disposed therein to provide a torque path to a rotary table disposed in the rig floor.

9. The method of claim 6, wherein the hydraulic jacking system is capable of lifting with forces in a range of about 120,000 pounds (lbs) to about 600,000 pounds (lbs) and at least one of snubbing and pushing with forces in a range of about 60,000 pounds (lbs) to about 300,000 pounds (lbs).

10. The method of claim 6, the device further comprising:

a blow-out pressure system disposed in a frame system beneath the second portion of the hydraulic jacking system and at least partially internal to the hydraulic tensioning cylinder system.

11. A device comprising:

a hydraulic tensioning cylinder system comprising at least one mandrel, at least one flexjoint swivel assembly in communication with the at least one mandrel, at least one manifold in communication with the at least one flexjoint swivel assembly, the at least one manifold having a first radial fluid band and a second radial fluid band, a plurality of tensioning cylinders each having an upper blind end, a lower rod end, and at least one transfer tubing, the upper blind end being in communication with the first radial fluid band, the at least one transfer tubing being in communication with the second radial fluid band and the lower rod end being in communication with a bearing joint that is a flexjoint bearing, and a base in communication with the bearing joint, the hydraulic tensioning cylinder system disposed beneath a rig floor and adapted to be connected at the at least one mandrel to the rig floor through a rotary table disposed in the rig floor; and a well intervention apparatus disposed at least partially within the hydraulic tensioning cylinder system beneath the rig floor, the well intervention apparatus capable of being used in conjunction with at least one of a well, a wellhead, a blow-out pressure system, a jointed tubular, a pipe, and a drilling string.

12. The device of claim 11, wherein the well intervention apparatus comprises at least one of a hydraulic workover device, a hydraulic jacking system, a coiled tubing apparatus, a wireline device, a slickline device, and an electric line.

13. The device of claim 12, wherein the well intervention apparatus comprises:

at least one of the hydraulic workover device, the coiled tubing apparatus, the wireline device, the slickline device, and the electric line;

the hydraulic jacking system comprising a plurality of hydraulic cylinders, the hydraulic jacking system having a first portion and a second portion, the hydraulic jacking system disposed within the hydraulic tensioning cylinder system beneath the rig floor;

stationary/rotary slips disposed within the hydraulic tensioning cylinder system and connected to one of the first portion and the second portion of the hydraulic jacking system;

traveling slips disposed within the hydraulic tensioning cylinder system and connected to the one of the first portion and the second portion of the hydraulic jacking system not connected to the stationary/rotary slips; and a telescoping guide system disposed within the hydraulic tensioning cylinder system and connected to the traveling slips disposed within the hydraulic tensioning cylinder system.

14. The device of claim 11, wherein the hydraulic tensioning cylinder system is capable of at least one of lifting with and sustaining forces in a range of about 200,000 pounds (lbs) to about 1,500,000 pounds (lbs).

15. The device of claim 13 wherein at least one of the plurality of hydraulic cylinders has a spline torque tube disposed therein to provide a torque path to a rotary table disposed in the rig floor.

16. The device of claim 13, wherein the hydraulic jacking system is capable of lifting with forces in a range of about 120,000 pounds (lbs) to about 600,000 pounds (lbs) and at least one of snubbing and pushing with forces in a range of about 60,000 pounds (lbs) to about 300,000 pounds (lbs).

17. A method comprising:

providing a heave compensated hydraulic workover device comprising:

a hydraulic tensioning cylinder system comprising at least one mandrel, at least one flexjoint swivel assembly in communication with the at least one mandrel, at least one manifold in communication with the at least one flexjoint swivel assembly, the at least one manifold having a first radial fluid band and a second radial fluid band, a plurality of tensioning cylinders each having an upper blind end, a lower rod end, and at least one transfer tubing, the upper blind end being in communication with the first radial fluid band, the at least one transfer tubing being in communication with the second radial fluid band and the lower rod end being in communication with a bearing joint that is a flexjoint bearing, and a base in communication with the bearing joint, the hydraulic tensioning cylinder system disposed beneath a rig floor and adapted to be connected at the at least one mandrel to the rig floor through a rotary table disposed in the rig floor; and a well intervention apparatus disposed at least partially within the hydraulic tensioning cylinder system beneath the rig floor, the well intervention apparatus capable of being used in conjunction with at least one of a well, a wellhead, a blow-out pressure system, a jointed tubular, a pipe, and a drilling string; and using the heave compensated hydraulic workover device to intervene with and operate on the at least one of the well, the wellhead, the blow-out pressure system, the jointed tubular, the pipe, and the drilling string.

18. The method of claim 17, wherein the well intervention apparatus comprises at least one of a hydraulic workover device, a hydraulic jacking system, a coiled tubing apparatus, a wireline device, a slickline device, and an electric line.

19. The method of claim 18, wherein the well intervention apparatus comprises:

at least one of the hydraulic workover device, the coiled tubing apparatus, the wireline device, the slickline device, and the electric line;

the hydraulic jacking system comprising a plurality of hydraulic cylinders, the hydraulic jacking system having a first portion and a second portion, the hydraulic jacking system disposed within the hydraulic tensioning cylinder system beneath the rig floor;

stationary/rotary slips disposed within the hydraulic tensioning cylinder system and connected to one of the first portion and the second portion of the hydraulic jacking system;

traveling slips disposed within the hydraulic tensioning cylinder system and connected to the one of the first portion and the second portion of the hydraulic jacking system not connected to the stationary/rotary slips; and a telescoping guide system disposed within the hydraulic tensioning cylinder system and connected to the traveling slips disposed within the hydraulic tensioning cylinder system.

20. The method of claim 17, wherein the hydraulic tensioning cylinder system is capable of at least one of lifting with and sustaining forces in a range of about 200,000 pounds (lbs) to about 1,500,000 pounds (lbs).

21. The method of claim 19, wherein at least one of the plurality of hydraulic cylinders has a spline torque tube disposed therein to provide a torque path to a rotary table disposed in the rig floor.

22. The method of claim 19, wherein the hydraulic jacking system is capable of lifting with forces in a range of about 120,000 pounds (lbs) to about 600,000 pounds (lbs) and at least one of snubbing and pushing with forces in a range of about 60,000 pounds (lbs) to about 300,000 pounds (lbs).

* * * * *